US010681935B2

(12) United States Patent
Sherwood et al.

(10) Patent No.: US 10,681,935 B2
(45) **Date of Patent: *Jun. 16, 2020**

(54) BANDED CIGARETTE WRAPPER WITH OPENED-AREA BANDS

(71) Applicant: Altria Client Services LLC, Richmond, VA (US)

(72) Inventors: Timothy S. Sherwood, Midlothian, VA (US); Robert Kikkert, Charles City, VA (US); Robert N. Smith, Glen Allen, VA (US); Ali A. Rostami, Glen Allen, VA (US); Georgios Karles, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 372 days.

This patent is subject to a terminal disclaimer.

(21) Appl. No.: 15/583,163

(22) Filed: May 1, 2017

(65) Prior Publication Data

US 2017/0231270 A1 Aug. 17, 2017

Related U.S. Application Data

(62) Division of application No. 13/896,087, filed on May 16, 2013, now Pat. No. 9,668,516.

(60) Provisional application No. 61/647,906, filed on May 16, 2012.

(51) Int. Cl.
*A24D 1/02* (2006.01)

(52) U.S. Cl.
CPC ..... *A24D 1/025* (2013.01)

(58) Field of Classification Search
CPC ..... A24D 1/025; A24D 1/02
See application file for complete search history.

(56) References Cited

U.S. PATENT DOCUMENTS

| | | | |
|---|---|---|---|
| 1,555,320 | A | 9/1925 | Weil |
| 1,581,451 | A | 4/1926 | Knapp |
| 1,581,619 | A | 4/1926 | Sulzberger |
| 1,909,924 | A | 5/1933 | Schweitzer et al. |

(Continued)

FOREIGN PATENT DOCUMENTS

| | | | |
|---|---|---|---|
| BE | 779470 | A1 | 6/1972 |
| CA | 952656 | A1 | 8/1974 |

(Continued)

OTHER PUBLICATIONS

Chapman, Simon et al., "Reduction-Ignition Propensity Cigarettes," Aug. 25, 2004, XP55006441, http://www.health.gov.au/internet/main/publishing.nsf/Content/1526AD854C903649CA256F8E0011ACBE/$File/smoking_rip.pdf [retrieved on Sep. 7, 2011].

(Continued)

*Primary Examiner* — Michael H. Wilson
*Assistant Examiner* — Dionne W. Mayes
(74) *Attorney, Agent, or Firm* — Buchanan Ingersoll & Rooney PC

(57) ABSTRACT

A wrapper of a smoking article comprising a base web and banded regions comprising a leading edge, a trailing edge and a plurality of add-on material-free openings between said leading edge and said trailing edge. The add-on material-free openings establish a predetermined, nominal opened-area within said banded regions to control diffusivity. The add-on material can be applied by a gravure roller comprising a surface region with cells, cell-free areas and a chevron shape.

19 Claims, 10 Drawing Sheets

(56) References Cited

U.S. PATENT DOCUMENTS

| | | | |
|---|---|---|---|
| 1,996,002 | A | 3/1935 | Seaman |
| 1,999,222 | A | 4/1935 | Weinberger |
| 1,999,223 | A | 4/1935 | Weinberger |
| 1,999,224 | A | 4/1935 | Miles |
| 2,013,508 | A | 9/1935 | Seaman |
| 2,020,646 | A | 11/1935 | Hornstein |
| 2,022,004 | A | 11/1935 | Larson |
| 2,049,320 | A | 7/1936 | Ruben et al. |
| 2,098,619 | A | 11/1937 | Finnell |
| 2,149,896 | A | 3/1939 | McArdle et al. |
| 2,246,929 | A | 6/1941 | Seney |
| 2,307,088 | A | 1/1943 | Whiteley |
| 2,580,568 | A | 1/1952 | Matthews et al. |
| 2,580,608 | A | 1/1952 | Schur et al. |
| 2,666,437 | A | 1/1954 | Lattof |
| 2,718,889 | A | 9/1955 | Claussen |
| 2,733,720 | A | 2/1956 | Schur et al. |
| 2,754,207 | A | 7/1956 | Schur et al. |
| 2,886,042 | A | 5/1959 | Hoover et al. |
| 2,976,190 | A | 3/1961 | Meyer |
| 2,998,012 | A | 8/1961 | Lamm |
| 3,030,963 | A | 4/1962 | Cohn |
| 3,106,210 | A | 10/1963 | Reynolds |
| 3,370,593 | A | 2/1968 | Owaki |
| 3,395,714 | A | 8/1968 | Kahane |
| 3,409,021 | A | 11/1968 | Owaki |
| 3,477,440 | A | 11/1969 | Licis |
| 3,511,247 | A | 5/1970 | Tamol |
| 3,517,672 | A | 6/1970 | Michelson |
| 3,526,904 | A | 9/1970 | Tamol |
| 3,633,589 | A | 1/1972 | Kahane et al. |
| 3,640,285 | A | 2/1972 | Briskin et al. |
| 3,667,479 | A | 6/1972 | Sanford et al. |
| 3,699,973 | A | 10/1972 | Tamol et al. |
| 3,705,588 | A | 12/1972 | Tamol et al. |
| 3,722,515 | A | 3/1973 | Reynolds et al. |
| 3,782,393 | A | 1/1974 | Michelson |
| 3,805,799 | A | 4/1974 | Stewart, Jr. et al. |
| 3,903,899 | A | 9/1975 | Musillo |
| 3,908,671 | A | 9/1975 | Cogbill, II |
| 3,911,932 | A | 10/1975 | Houck, Jr. et al. |
| 4,020,850 | A | 5/1977 | Cogbill, II |
| 4,038,992 | A | 8/1977 | Ogasa et al. |
| 4,044,778 | A | 8/1977 | Cohn |
| 4,061,147 | A | 12/1977 | Falchi |
| 4,077,414 | A | 3/1978 | Baker et al. |
| 4,088,142 | A | 5/1978 | Horsewell et al. |
| 4,129,134 | A | 12/1978 | Hind et al. |
| 4,146,040 | A | 3/1979 | Cohn |
| 4,149,550 | A | 4/1979 | Green et al. |
| 4,187,862 | A | 2/1980 | Cohn |
| 4,193,409 | A | 3/1980 | Wahle et al. |
| 4,225,636 | A | 9/1980 | Cline et al. |
| 4,230,131 | A | 10/1980 | Simon |
| 4,231,377 | A | 11/1980 | Cline et al. |
| 4,236,532 | A | 12/1980 | Schweizer et al. |
| 4,239,591 | A | 12/1980 | Blake |
| 4,277,301 | A | 7/1981 | McIntyre et al. |
| 4,286,605 | A | 9/1981 | Goslin et al. |
| 4,295,478 | A | 10/1981 | Yeatts |
| 4,326,543 | A | 4/1982 | Martin et al. |
| 4,340,074 | A | 7/1982 | Tudor |
| 4,371,571 | A | 2/1983 | McIntyre et al. |
| 4,406,295 | A | 9/1983 | Sanford et al. |
| 4,411,279 | A | 10/1983 | Martin et al. |
| 4,453,553 | A | 1/1984 | Cohn |
| 4,450,847 | A | 5/1984 | Owens |
| 4,452,259 | A | 6/1984 | Norman et al. |
| 4,480,650 | A | 11/1984 | Weinert |
| 4,489,738 | A | 12/1984 | Simon |
| 4,590,955 | A | 5/1986 | Dixit |
| 4,607,647 | A | 8/1986 | Dashley et al. |
| 4,615,345 | A | 10/1986 | Durocher |
| 4,619,289 | A | 10/1986 | Smeed et al. |
| 4,622,983 | A | 11/1986 | Mathews et al. |
| 4,679,575 | A | 7/1987 | Yamaguchi et al. |
| 4,691,717 | A | 9/1987 | Ikeda et al. |
| 4,716,912 | A | 1/1988 | Leonard |
| 4,730,628 | A | 3/1988 | Townsend et al. |
| 4,739,775 | A | 4/1988 | Hampl, Jr. |
| 4,776,355 | A | 10/1988 | Stevenson et al. |
| 4,784,163 | A | 11/1988 | Adams et al. |
| 4,784,164 | A | 11/1988 | Adams et al. |
| 4,889,145 | A | 12/1989 | Adams et al. |
| 4,924,883 | A | 5/1990 | Perfetti et al. |
| 4,924,888 | A | 5/1990 | Perfetti et al. |
| 4,941,486 | A | 7/1990 | Dube et al. |
| 4,942,888 | A | 7/1990 | Montoya et al. |
| 4,945,932 | A | 8/1990 | Mentzel et al. |
| 4,998,542 | A | 3/1991 | Kallianos et al. |
| 4,998,543 | A | 3/1991 | Goodman et al. |
| 5,060,675 | A | 10/1991 | Milford et al. |
| 5,072,744 | A | 12/1991 | Luke et al. |
| 5,074,321 | A | 12/1991 | Gentry et al. |
| 5,085,228 | A | 2/1992 | Mooney et al. |
| 5,092,353 | A | 3/1992 | Montoya et al. |
| 5,094,253 | A | 3/1992 | St. Charles et al. |
| 5,101,839 | A | 4/1992 | Jakob et al. |
| 5,101,840 | A | 4/1992 | Riehl, Jr. |
| 5,103,844 | A | 4/1992 | Hayden et al. |
| 5,105,836 | A | 4/1992 | Gentry et al. |
| 5,105,838 | A | 4/1992 | White et al. |
| 5,107,866 | A | 4/1992 | Aronoff et al. |
| 5,109,876 | A | 5/1992 | Hayden et al. |
| 5,129,408 | A | 7/1992 | Jakob et al. |
| 5,143,098 | A | 9/1992 | Rogers et al. |
| 5,144,964 | A | 9/1992 | Demain |
| 5,144,966 | A | 9/1992 | Washington |
| 5,144,967 | A | 9/1992 | Cartwright et al. |
| 5,152,304 | A | 10/1992 | Bokelman et al. |
| 5,154,191 | A | 10/1992 | Owens, Jr. |
| 5,155,140 | A | 10/1992 | Marten et al. |
| 5,168,884 | A | 12/1992 | Baldwin et al. |
| 5,170,807 | A | 12/1992 | Kasbo et al. |
| 5,178,167 | A | 1/1993 | Riggs et al. |
| 5,191,906 | A | 3/1993 | Myracle, Jr. |
| 5,220,930 | A | 6/1993 | Gentry |
| 5,244,530 | A | 9/1993 | Collins et al. |
| 5,263,500 | A | 11/1993 | Baldwin et al. |
| 5,263,999 | A | 11/1993 | Baldwin et al. |
| 5,271,419 | A | 12/1993 | Arzonico et al. |
| 5,329,004 | A | 7/1994 | Eden et al. |
| 5,342,484 | A | 8/1994 | Cutright et al. |
| 5,345,950 | A | 9/1994 | Adebar et al. |
| 5,396,911 | A | 3/1995 | Casey, III et al. |
| 5,415,186 | A | 5/1995 | Casey, III et al. |
| 5,417,228 | A | 5/1995 | Baldwin et al. |
| 5,450,862 | A | 9/1995 | Baldwin et al. |
| 5,450,863 | A | 9/1995 | Collins et al. |
| 5,464,028 | A | 11/1995 | Takeda et al. |
| 5,465,739 | A | 11/1995 | Perfetti et al. |
| 5,474,095 | A | 12/1995 | Allen et al. |
| 5,490,875 | A | 2/1996 | Wermers et al. |
| 5,490,876 | A | 2/1996 | Warmerdam et al. |
| 5,492,568 | A | 2/1996 | Warmerdam et al. |
| 5,497,793 | A | 3/1996 | Kubica |
| 5,498,224 | A | 3/1996 | Kauffman et al. |
| 5,507,304 | A | 4/1996 | Maheras et al. |
| 5,523,036 | A | 6/1996 | Lake et al. |
| 5,529,619 | A | 6/1996 | Warmerdam et al. |
| 5,534,114 | A | 7/1996 | Cutright et al. |
| 5,538,018 | A | 7/1996 | Chan et al. |
| 5,538,019 | A | 7/1996 | Bullwinkel et al. |
| 5,540,242 | A | 7/1996 | Chao et al. |
| 5,589,034 | A | 12/1996 | Hultman et al. |
| 5,595,196 | A | 1/1997 | Salonen et al. |
| 5,598,868 | A | 2/1997 | Jakob et al. |
| 5,613,505 | A | 3/1997 | Campbell et al. |
| 5,641,349 | A | 6/1997 | Koubek et al. |
| 5,690,787 | A | 11/1997 | Hultman et al. |
| 5,702,555 | A | 12/1997 | Caudal et al. |
| 5,709,227 | A | 1/1998 | Arzonice et al. |
| 5,730,840 | A | 3/1998 | Hampl, Jr. et al. |
| 5,732,718 | A | 3/1998 | Douglas et al. |

(56) References Cited

U.S. PATENT DOCUMENTS

| | | | |
|---|---|---|---|
| 5,820,998 | A | 10/1998 | Hotaling et al. |
| 5,824,190 | A | 10/1998 | Guerro et al. |
| 5,830,318 | A | 11/1998 | Snow et al. |
| 5,878,753 | A | 3/1999 | Peterson et al. |
| 5,878,754 | A | 3/1999 | Peterson et al. |
| 5,882,755 | A | 3/1999 | Igarashi et al. |
| 5,888,348 | A | 3/1999 | Hampl, Jr. |
| 5,893,372 | A | 4/1999 | Hampl, Jr. |
| 5,911,224 | A | 6/1999 | Berger |
| 5,921,249 | A | 7/1999 | Hampl, Jr. |
| 5,974,732 | A | 11/1999 | Saito |
| 5,985,323 | A | 11/1999 | Augello et al. |
| 5,992,420 | A | 11/1999 | Moriyama |
| 5,997,691 | A | 12/1999 | Gautam et al. |
| 6,020,969 | A | 2/2000 | Struckhoff et al. |
| 6,095,152 | A | 8/2000 | Beven et al. |
| 6,129,087 | A | 10/2000 | Wallace et al. |
| 6,198,537 | B1 | 3/2001 | Bokelman et al. |
| 6,305,382 | B1 | 10/2001 | Hampl, Jr. |
| 6,397,852 | B1 | 6/2002 | McAdam |
| 6,568,403 | B2 | 5/2003 | Hampl, Jr. et al. |
| 6,584,981 | B2 | 7/2003 | Hampl, Jr. |
| 6,596,125 | B2 | 7/2003 | Garg et al. |
| 6,606,999 | B2 | 8/2003 | Crooks et al. |
| 6,645,605 | B2 | 11/2003 | Hammersmith et al. |
| 6,676,806 | B1 | 1/2004 | Butt |
| 6,705,325 | B1 | 3/2004 | Hicks et al. |
| 6,725,867 | B2 | 4/2004 | Peterson et al. |
| 6,779,530 | B2 | 8/2004 | Kraker |
| 6,779,531 | B1 | 8/2004 | Biggs et al. |
| 6,789,548 | B2 | 9/2004 | Bereman |
| 6,799,578 | B2 | 10/2004 | Snaidr et al. |
| 6,823,872 | B2 | 11/2004 | Hampl, Jr. |
| 6,837,248 | B2 | 1/2005 | Zawadzki et al. |
| 6,959,712 | B2 | 1/2005 | Bereman et al. |
| 6,929,013 | B2 | 8/2005 | Ashcraft et al. |
| 6,976,493 | B2 | 12/2005 | Chapman et al. |
| 6,997,190 | B2 | 2/2006 | Stokes et al. |
| 7,047,982 | B2 | 5/2006 | Seymour et al. |
| 7,073,514 | B2 | 7/2006 | Barnes et al. |
| 7,077,145 | B2 | 7/2006 | Seymour et al. |
| 7,115,085 | B2 | 10/2006 | Deal |
| 7,116,750 | B1 | 10/2006 | Iaquinta et al. |
| 7,117,871 | B2 | 10/2006 | Hancock et al. |
| 7,195,019 | B2 | 3/2007 | Hancock et al. |
| 7,234,471 | B2 | 6/2007 | Fitzgerald et al. |
| 7,237,558 | B2 | 7/2007 | Clark et al. |
| 7,237,559 | B2 | 7/2007 | Ashcraft et al. |
| 7,240,678 | B2 | 7/2007 | Crooks |
| 7,275,548 | B2 | 10/2007 | Hancock et al. |
| 7,275,549 | B2 | 10/2007 | Hancock et al. |
| 7,276,120 | B2 | 10/2007 | Holmes |
| 7,281,540 | B2 | 10/2007 | Barnes et al. |
| 7,290,549 | B2 | 11/2007 | Banerjee et al. |
| 7,296,578 | B2 | 11/2007 | Read, Jr. |
| 7,363,929 | B2 | 4/2008 | Fagg et al. |
| 8,337,664 | B2 | 12/2012 | Cunningham et al. |
| 9,668,516 | B2 | 6/2017 | Sherwood et al. |
| 2002/0179105 | A1 | 12/2002 | Zawadzki et al. |
| 2002/0179106 | A1 | 12/2002 | Zawadzki et al. |
| 2003/0131860 | A1 | 7/2003 | Ashcraft et al. |
| 2003/0136420 | A1 | 7/2003 | Kraker |
| 2003/0145869 | A1 | 8/2003 | Kitao et al. |
| 2003/0217757 | A1 | 11/2003 | Edelmann |
| 2004/0025894 | A1 | 2/2004 | Beven et al. |
| 2004/0074508 | A1 | 4/2004 | McAdam et al. |
| 2004/0099280 | A1 | 5/2004 | Stokes et al. |
| 2004/0122547 | A1 | 6/2004 | Seymour et al. |
| 2004/0123874 | A1 | 7/2004 | Zawadzki et al. |
| 2004/0129281 | A1 | 7/2004 | Hancock et al. |
| 2004/0134631 | A1 | 7/2004 | Crooks et al. |
| 2004/0168695 | A1 | 9/2004 | Snaidr et al. |
| 2004/0173229 | A1 | 9/2004 | Crooks et al. |
| 2004/0182407 | A1 | 9/2004 | Peterson et al. |
| 2004/0231685 | A1 | 11/2004 | Patel et al. |
| 2004/0237978 | A1 | 12/2004 | Barnes et al. |
| 2004/0238136 | A1 | 12/2004 | Patel et al. |
| 2004/0255966 | A1 | 12/2004 | Kraker |
| 2004/0261805 | A1 | 12/2004 | Wanna et al. |
| 2005/0000528 | A1 | 1/2005 | Bereman |
| 2005/0000529 | A1 | 1/2005 | Bereman et al. |
| 2005/0000531 | A1 | 1/2005 | Shi |
| 2005/0005947 | A1 | 1/2005 | Hampl et al. |
| 2005/0016556 | A1 | 1/2005 | Ashcraft et al. |
| 2005/0022833 | A1 | 2/2005 | Gedevanishvili et al. |
| 2005/0039767 | A1 | 2/2005 | Mua et al. |
| 2005/0051185 | A1 | 3/2005 | Rasouli et al. |
| 2005/0056293 | A1 | 3/2005 | Zawadzki et al. |
| 2005/0056294 | A1 | 3/2005 | Wanna et al. |
| 2005/0066980 | A1 | 3/2005 | Crooks et al. |
| 2005/0066982 | A1 | 3/2005 | Clark et al. |
| 2005/0066984 | A1 | 3/2005 | Crooks et al. |
| 2005/0076925 | A1 | 4/2005 | Fagg et al. |
| 2005/0076929 | A1 | 4/2005 | Fitzgerald et al. |
| 2005/0081869 | A1 | 4/2005 | Biggs et al. |
| 2005/0087202 | A1 | 4/2005 | Norman et al. |
| 2005/0103355 | A1 | 5/2005 | Holmes |
| 2005/0115575 | A1 | 6/2005 | Seymour et al. |
| 2005/0115579 | A1 | 6/2005 | Beven et al. |
| 2005/0166936 | A1 | 8/2005 | Snaidr |
| 2005/0172977 | A1 | 8/2005 | Jadot et al. |
| 2005/0178399 | A1 | 8/2005 | Shafer et al. |
| 2005/0211259 | A1 | 9/2005 | Gedevanishvili |
| 2005/0241659 | A1 | 11/2005 | Ray et al. |
| 2005/0241660 | A1 | 11/2005 | Ashcraft et al. |
| 2006/0005847 | A1 | 1/2006 | Chapman et al. |
| 2006/0011207 | A1 | 1/2006 | Chapman et al. |
| 2006/0124146 | A1 | 1/2006 | Stokes et al. |
| 2006/0021625 | A1 | 2/2006 | Nyffeler |
| 2006/0021626 | A1 | 2/2006 | Mua |
| 2006/0037621 | A1 | 2/2006 | Bereman et al. |
| 2006/0174904 | A1 | 8/2006 | Wanna |
| 2006/0207617 | A1 | 9/2006 | Seymour et al. |
| 2006/0231114 | A1 | 10/2006 | Oglesby et al. |
| 2006/0237024 | A1 | 10/2006 | Reich et al. |
| 2006/0243290 | A1 | 11/2006 | Reich et al. |
| 2007/0029060 | A1 | 2/2007 | Murray et al. |
| 2007/0051381 | A1 | 3/2007 | Hancock et al. |
| 2007/0056600 | A1 | 3/2007 | Coleman et al. |
| 2007/0084475 | A1 | 4/2007 | Oglesby et al. |
| 2007/0095357 | A1 | 5/2007 | Besso et al. |
| 2007/0102017 | A1 | 5/2007 | Sherwood et al. |
| 2007/0137668 | A1 | 6/2007 | Borschke et al. |
| 2007/0144545 | A1 | 6/2007 | Long et al. |
| 2007/0157940 | A1 | 7/2007 | Mua et al. |
| 2007/0169786 | A1 | 7/2007 | Li et al. |
| 2007/0175058 | A1 | 8/2007 | Bengi |
| 2007/0246055 | A1 | 10/2007 | Oglesby |
| 2007/0295348 | A1 | 12/2007 | Wann |
| 2008/0011312 | A1 | 1/2008 | Matsufuji et al. |
| 2008/0295854 | A1 | 12/2008 | Li et al. |
| 2011/0030709 | A1 | 2/2011 | Sebastian et al. |
| 2011/0155158 | A1 | 6/2011 | Li et al. |
| 2011/0297168 | A1 | 12/2011 | Li et al. |
| 2011/0297169 | A1 | 12/2011 | Li et al. |
| 2011/0297736 | A1 | 12/2011 | Li et al. |
| 2011/0300299 | A1 | 12/2011 | Li et al. |
| 2011/0303233 | A1 | 12/2011 | Li et al. |
| 2012/0031417 | A1 | 2/2012 | Li et al. |
| 2017/0231270 | A1 | 8/2017 | Sherwood et al. |

FOREIGN PATENT DOCUMENTS

| | | | |
|---|---|---|---|
| EP | 2849585 | A1 | 3/2015 |
| FR | 2136767 | A5 | 12/1972 |
| WO | WO 02/37991 | A1 | 5/2002 |
| WO | WO 03/088771 | A1 | 10/2003 |
| WO | WO 2005/002370D3 | | 1/2005 |
| WO | WO 2006/004343 | A1 | 1/2006 |
| WO | WO 2007/020532 | A1 | 2/2007 |
| WO | WO 2007/031965 | A2 | 3/2007 |
| WO | WO 2007/113693 | A2 | 10/2007 |

(56) References Cited

FOREIGN PATENT DOCUMENTS

| | | | |
|---|---|---|---|
| WO | WO 2009/087479 | A2 | 7/2009 |
| WO | 2011117998 | A | 7/2013 |
| WO | 2013173614 | A1 | 11/2013 |

OTHER PUBLICATIONS

Glogan, T., "Making fire-safe cigarettes a hot topic", Tobacco Journal International, vol. 2004, No. 2, Mar. 1, 2004, pp. 64-65.
Norman, Alan B. et al., "Measurement of Gas Diffusion Capacity of Cigarette Papers", Beiträge zur Tabakforschung International/Contributions to Tobacco Research, vol. 21, No. 8, pp. 425-434.
Rossel, Stefanie, "Canada's burning issue", Tobacco Journal International, vol. 2005, No. 4, Aug. 1, 2005, pp. 88-91, XP002562192.
"Standard Test Method for Measuring the Ignition Strength of Cigarettes", ASTM International, Designation E2187-4, pp. 1-8, published Aug. 2004.
"Standard Test Method for Measuring the Ignition Strength of Cigarettes", ASTM International, Designation E2187-09, pp. 1-8, published Jan. 2010.
International Preliminary Report on Patentability dated Sep. 30, 2008 for PCT/IB2007/002118.
International Search Report and Written Opinion dated Dec. 23, 2008 for PCT/IB2008/002399.
International Search Report and Written Opinion dated Dec. 23, 2008 for PCT/IB2008/002463.
International Search Report and Written Opinion dated Jan. 5, 2009 for PCT/IB2008/001839.
Partial International Search Report dated Mar. 6, 2009 for PCT/IB2008/002394.
International Search Report and Written Opinion dated Apr. 20, 2009 for PCT/IB2008/001840.
International Search Report and Written Opinion dated Apr. 23, 2009 for PCT/IB2008/002994.
Partial International Search Report dated Jun. 10, 2009 for PCT/IB2008/002635.
International Search Report and Written Opinion dated Aug. 19, 2009 for PCT/IB2008/002635.
International Preliminary Report on Patentability dated Nov. 24, 2009 for PCT/IB2008/002399.
International Preliminary Report on Patentability dated Dec. 1, 2009 for PCT/IB2008/001839.
International Preliminary Report on Patentability dated Dec. 1, 2009 for PCT/IB2008/001840.
International Preliminary Report on Patentability dated Dec. 1, 2009 for PCT/IB2008/002463.
International Preliminary Report on Patentability dated Jan. 14, 2010 for PCT/IB2008/002635.
International Preliminary Report on Patentability dated Feb. 2, 2010 for PCT/IB2008/002394.
International Preliminary Report on Patentability dated Mar. 2, 2010 for PCT/IB2008/002994.
International Search Report and Written Opinion dated Apr. 10, 2012 for PCT/US2011/64676.
Communication Pursuant to Rule 114(2) EPC dated Apr. 15, 2010 for European Appln. No. 07789552.2-2313.
Communication Pursuant to Article 94(3) EPC dated Sep. 14, 2011 for European Appln. No. 08 807 078.4-2302.
International Search Report and Written Opinion dated Jul. 27, 2012 for PCT/US2012/038123.
International Search Report and Written Opinion dated Sep. 24, 2013 for PCT/US2013/041406.
International Search Report and Written Opinion dated Sep. 30, 2013 for PCT/US2013/041395.
International Search Report and Written Opinion dated Sep. 30, 2013 for PCT/US2013/041402.
Official Action dated Nov. 2, 2011 for corresp. Chinese Appln. No. 200880017648.2.
Official Action dated Nov. 10, 2011 for corresp. Chinese Appln. No. 200880024668.2.
Commonly Owned U.S. Appl. No. 61/064,439, filed Mar. 8, 2009.
Commonly Owned U.S. Appl. No. 12/153,783, filed May 23, 2008 (U.S. Pat. No. 8,925,556).
Commonly Owned U.S. Appl. No. 13/040,617, filed Mar. 4, 2011 (U.S. Pat. No. 8,707,967).
Commonly Owned U.S. Appl. No. 13/212,050, filed Aug. 17, 2011 (U.S. Pat. No. 8,939,156).
Commonly Owned U.S. Appl. No. 13/212,058, filed Aug. 17, 2011 (U.S. Pat. No. 8,844,540).
Commonly Owned U.S. Appl. No. 13/212,064, filed Aug. 17, 2011 (U.S. Pat. No. 8,833,377).
Commonly Owned U.S. Appl. No. 13/212,081, filed Aug. 17, 2011 (U.S. Pat. No. 9,161,570).
Commonly Owned U.S. Appl. No. 13/212,091, filed Aug. 17, 2011 (U.S. Pat. No. 8,905,043).
Commonly Owned U.S. Appl. No. 13/212,095, filed Aug. 17, 2011 (U.S. Pat. No. 8,733,370).
Commonly Owned U.S. Appl. No. 13/473,007, filed May 16, 2012 (U.S. Patent Publication No. 2013/0087161).
Commonly Owned U.S. Appl. No. 13/324,747, filed Dec. 13, 2011 (U.S. Pat. No. 9,302,522).
Commonly Owned U.S. Appl. No. 13/896,087, filed May 16, 2013 (U.S. Patent Publication No. 2013/0306082).
Commonly Owned U.S. Appl. No. 13/896,068, filed May 16, 2013 (U.S. Patent Publication No. 2013/0306088).
Commonly Owned U.S. Appl. No. 13/896,040, filed May 16, 2013 (U.S. Patent Publication No. 2013/0306087).
International Preliminary Report on Patentability dated Nov. 27, 2014 for corresponding PCT Application No. PCT/US2013/041406.
Search Report dated Jun. 11, 2015, by the European Patent Office in corresponding European Patent Application No. EP 13 79 0008 (5 pages).
Office Action dated Aug. 6, 2018 in corresponding Japanese Patent Application No. 2017-154501 with partial English translation, 9 pages.
Office Action dated Mar. 21, 2019 in corresponding Canadian Patent Application No. 2,873,781, 4 pages.

BANDED CIGARETTE WRAPPER WITH OPENED-AREA BANDS

CROSS-REFERENCE TO RELATED APPLICATIONS

This application is a divisional application of U.S. patent application Ser. No. 13/896,087, filed May 16, 2013, which claims priority under 35 U.S.C. § 119(e) to U.S. Provisional Application No. 61/647,906, filed on May 16, 2012, the entire content of each is incorporated herein by reference.

WORKING ENVIRONMENT

Ignition Propensity ("IP")

A measure of the tendency of a smoking article to cause ignition when left placed upon a substrate is the Ignition Propensity value. An Ignition Propensity value, or IP value, of a smoking article should preferably be no greater than about 25%. More preferably, the IP value should be no greater than about 20%; and even more preferably no greater than about 10%.

Ignition Propensity or IP is a standard test conducted as set forth in ASTM E 2187-04, "Standard Test Method for Measuring the Ignition Strength of Smoking articles", which is incorporated herein in its entirety by this reference thereto. Ignition propensity measures the probability that a smoking article, when smoldering and placed on a substrate, will generate sufficient heat to maintain smoldering of the tobacco rod. Low values for IP are desirable as such values correlate with a reduced likelihood that a smoldering smoking article, when inadvertently left unattended upon a substrate, will cause combustion in the substrate.

Self Extinguishment ("SE")

Smoking articles exhibiting reduced IP values typically also tend to self-extinguish between puffs during smoldering, which is contrary to adult consumer expectations. Adult consumers do not like having to re-light a cigarette during their smoking experience.

A measure of the tendency for a smoking article to self-extinguish during free burn has been developed and is known as the Self-Extinguishment value. The Self-Extinguishment value or SE value has been found to be a useful indicia of the likelihood of a smoking article to self-extinguish between puffs during smoking. The Self-Extinguishment Average value for a smoking article should preferably be no greater than about 80% and/or the Self-Extinguishment at 0° value (0° indicating that the cigarette is smoldering in horizontal orientation) should be no greater than about 50%, and more preferably no greater than about 25%.

Self-Extinguishment or SE herein is a reference to smoldering characteristics of a smoking article under free burn conditions (away from any substrate). To evaluate SE, a laboratory test is conducted at a temperature of 23° C.±3° C. and relative humidity of 55%±5%, both of which should be monitored by a recording hygrothermograph. Exhaust hood(s) remove combustion products formed during testing. Prior to testing, smoking articles to be tested are conditioned at 55%±5% relative humidity and 23° C.±3° C. for at least 24 hours. To facilitate conditioning, the smoking articles are placed in glass beakers to assure free air access.

SE testing takes place within an enclosure or test box. A single port smoking machine or an electric lighter is used to ignite the smoking articles for the test. During testing, an apparatus or "angle holder" holds the smoking articles to be tested by holding an end at angles of 0° (horizontal), 45°, and/or 90° (vertical). Preferably, twenty (20) smoking articles are tested at each of the 0°, 45°, and 90° positions. If more than one apparatus is used, the apparatuses are preferably positioned such that the smoking articles face away from each other to avoid cross interference. If a smoking article goes out before the front line of the smoldering coal reaches the tipping paper, the outcome is scored as "self-extinguishment"; on the other hand, if the smoking article continues smoldering until the front line of the smoldering coal reaches the tipping paper, then the outcome is scored as "non-extinguishment". Thus, for example, an SE value of 95% indicates that 95% of the smoking articles tested exhibited self-extinguishment under the free burn conditions; while an SE value of 20% indicates that only 20% of the smoking articles tested exhibited self-extinguishment under such free burn conditions.

The SE value may be referred to in terms of "Self-Extinguishment at 0° value", "Self-Extinguishment at 45° value", or "Self-Extinguishment at 90° value", each of which refers to the value of SE at the specified tested angle. In addition, the SE value may be referred to in terms of "Self-Extinguishment Average value", which refers to an average of the three angular positions: namely, an average of (i) the "Self-Extinguishment at 0° value" (level, or horizontal orientation), (ii) the "Self-Extinguishment at 45° value", and (iii) the "Self-Extinguishment at 90° value" (vertical orientation). A reference to "Self-Extinguishment value" or "SE value" does not distinguish between SE at 0°, SE at 45°, SE at 90°, or SE average values and may refer to any one of them.

As noted above, it is desirable to achieve IP performance with a patterned paper that meets and exceeds governmental requirements. As previously noted, achievement of a desired IP performance often adversely impacts the SE performance of the smoking article. Stated differently, while an IP performance of a smoking article may meet or exceed the governmental requirement (i.e., it has a 0% IP value), that level of IP performance typically results in a smoking article that will self-extinguish when the cigarette smolders away from any substrate (i.e., it has an SE value of 100%). Improvement of SE performance while maintaining requisite IP performance constitutes a highly desirable feature for cigarette wrappers and smoking articles constructed from them. Applicants have discovered arrangements of the banded regions on wrapper that provide such improved SE performance while maintaining the desired or requisite IP performance.

SUMMARY

Embodiments herein disclosed include banded papers and smoking articles constructed from such papers.

In an exemplary preferred embodiment, a wrapper of a smoking article includes a base web and add-on material applied to the base web in the form of a band. The band comprises add-on material applied according to a nominal total band area and including a pattern of material-free regions within the band that collectively establish a nominal opened-area of the band in the range of about 4 to about 9% of the nominal total band area. Preferably, the add-on material is aqueous and the add-on material includes an anti-wrinkling agent, calcium carbonate and starch. The anti-wrinkling agent is preferably selected from the group consisting of propylene glycol; 1,2 propylene glycol; and glycerin. The bands together with the opened-areas achieve a diffusivity value in the range of 0 to about 0.2 cm/sec, and preferably in the range of about 0.12 to about 0.15 cm/sec.

Another preferred embodiment involves a process of making wrapper paper of a smoking article. The process includes the steps of providing a base web and applying add-on material in the form of at least one banded region according to a nominal total band area and including a pattern of material-free areas that collectively establish a nominal-opened area of the band in the range of about 4 to about 9% of the nominal total band area. The method may further include slitting the base web to form bobbins for use in machines for making smoking articles.

Preferably, the banded regions are applied using a gravure roller having engraving (etched portions) comprising a plurality of cells corresponding with the nominal total band areas and cell-free areas corresponding to the material free regions of the desired web pattern. Preferably, the banded regions are applied to the base web as a pattern of transversely extending chevrons having an apex. Preferably the apex at the leading edge of a first chevron is transverse of or in an advanced relation to outer edge portions of an adjacent chevron.

In yet other embodiments, a gravure roller comprises a region of etched cells and numerous islands or pillars defined by the absence of such cells, which cooperate with a doctor blade of a printing apparatus.

BRIEF DESCRIPTION OF THE DRAWINGS

Many objects and advantages of the present disclosure will be apparent to those skilled in the art when this specification is read in conjunction with the accompanying drawings, wherein like reference numerals are applied to like elements and wherein.

DETAILED DESCRIPTION

Figure 1:
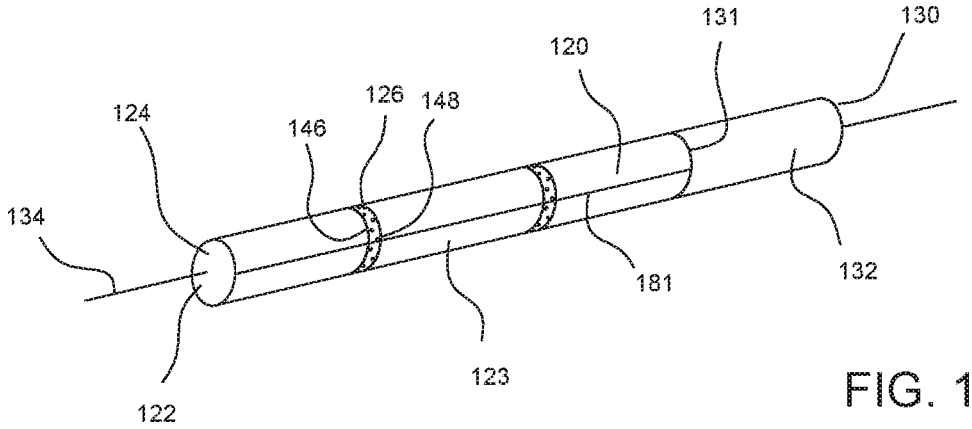
FIG. 1 is a schematic perspective view of a smoking article according to this disclosure.

Referring to FIG. 1, this disclosure concerns a smoking article 120, such as a cigarette, which preferably comprises a tobacco rod 122 and a filter 132 attached to the tobacco rod 122 with tipping paper. Preferably, the tobacco rod 122 comprises a column of shredded tobacco ("cut filler") and a wrapper 123 disposed about the column of tobacco, which wrapper 123 is constructed in accordance with teachings which follow. The tobacco rod 122 has a lightable or lit end 124 and a tipped end 130 (which in the case of non-filter cigarettes, is referenced as the mouth end 130 of the cigarette 120). Cut filler tobacco is an industry-standard designation. Further, the tobacco rod 122 typically has a generally circular cross section, although other oval cross section and other shapes are within the scope of this disclosure. The wrapper is sealed along a longitudinal seam 181 to form the tobacco rod 122.

The tobacco rod has a nominal length measured from the edge 131 of the tipping paper to the lit end 124 of the tobacco rod along a longitudinal axis 134 of smoking article. By way of example, that nominal length may lie in the range of about 50 to about 100 mm.

Figure 2:
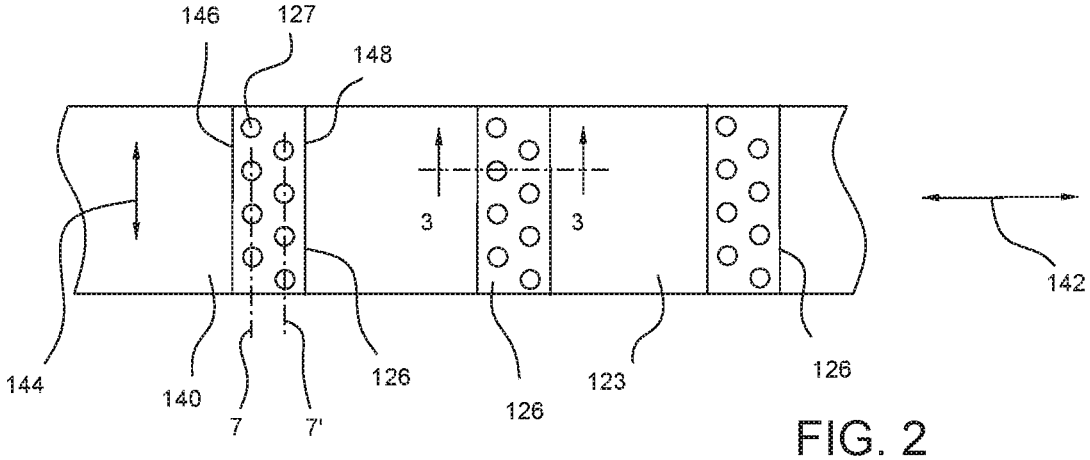
FIG. 2 is a schematic view of a wrapping paper a first embodiment according to this disclosure.

As shown in FIG. 2, the wrapper 123 typically includes a "base web" 140 that may be made from flax, wood pulp, cellulose fiber, or the like, and may have a plurality of banded regions or zones 126 applied to one or both sides of the base web 140. Preferably, the banded region 126 is applied to the inside of the wrapper 123 in the sense of how the wrapper 123 surrounds a column of tobacco in the tobacco rod 122 (shown in FIG. 1).

As used herein, the phrase "leading edge" refers to the edge 146 (see FIG. 1) of a banded region 126 that is closest to an approaching coal during smoldering of a smoking article 120 whose wrapper 123 contains the banded region 126, while the phrase "trailing edge" refers to the edge 148 of a banded region 126 that is farthest from an approaching coal during smoldering of a smoking article 120 whose wrapper 123 contains the banded region 126.

It is noted for sake of convention that, in describing dimensions of various embodiments herein, that the "width" of a band or zone 126 extends in a longitudinal direction 134 when the bands are configured as "circumferential" or "ring-like" bands as shown in FIG. 1, whereas a dimension in the circumferential direction will be expressed as "circumferential" or "transverse" or "in cross-direction." For longitudinally extending bands ("stripes), the width of the band is oriented instead in a transverse direction.

For purposes of this disclosure, "band spacing" refers to the distance between the trailing edge 148 banded region 126 and the nearest leading edge 146 of an adjacent banded region 126.

For purposes of this disclosure, "layer" refers to a unitary quantity of add-on material applied to a base web from which a wrapper is fabricated. A banded region or zone 126 may be fashioned from one or more layers 126 (see FIG. 3) that may be superimposed on one another. Each banded region 126 may be formed by applying one or more "layers" of an aqueous film-forming composition to the base web 140 of the wrapper to reduce the permeability of the paper in the corresponding banded region. Alternatively, a cellulosic or a "solvent-based" material may also be used to form the banded regions. The film-forming composition is preferably starch or modified starch in an aqueous solution; however, other materials may also be used in non-aqueous solvents or combinations of solvents including by way of example and without limitation: alginates, pectins, cellulose derivatives, ethylene vinyl acetate copolymers, guar gum, xanthan gum, polyvinyl acetate, polyvinyl alcohol, and the like.

For purposes of this disclosure, "longitudinal" refers to the direction along the length of a tobacco rod (e.g., along the axis 134 in FIG. 1), or along the length of a base web 140 (e.g., arrow 142 in FIG. 2) used in the preparation of wrapper that, in turn, may be used to fabricate a tobacco rod, or in the so-called machine-direction of a printing press, i.e., the direction through which a base web is drawn through its print station(s).

For purposes of this disclosure, "transverse" refers to the direction circumferentially around a tobacco rod 122 (see FIG. 1), or transversely of a base web 140 (e.g., arrow 144 in FIG. 2) which corresponds with the so-called cross-machine direction of a printing press.

Preferably, the transverse dimensions of the wrapper 123 are selected based on the diameter of the finished smoking article (about 7 to about 10 mm) and allowing for overlapping material at a longitudinal seam of about 1 to about 2 mm. For example, allowing for about 2 mm overlapping seams, the wrapper-paper cross-web dimension may be about 27 mm for a smoking article having a circumference of about 24.8 mm.

In this specification, the unit of measurement for basis weight, gram(s) per square meter, is abbreviated as "gsm".

When the phrase "weight percent" is used herein with respect to the starch component of a starch solution, the "weight percent" is the ratio of the weight of starch used to the total weight of the starch solution. Unless noted otherwise, when the phrase "weight percent" is used herein with respect to any component other than the starch component of a starch solution, the "weight percent" is the ratio of the weight of that other component to the weight of the starch component.

The wrapper includes a base web which typically is permeable to air. Permeability of wrapper is typically identified in CORESTA units. A CORESTA unit measures paper permeability in terms of volumetric flow rate (i.e., $cm^3$/sec) per unit area (i.e., $cm^2$) per unit pressure drop (i.e., cm of water). The base web of conventional wrapper also has well-known basis weights, measured in grams per square meter, abbreviated as "gsm". The permeability and basis weight for base web of typical smoking article papers commonly used in the industry are set out in the table below:

| Permeability, CORESTA units | Basis Weight, gsm |
|---|---|
| 24 | 25 |
| 33 | 24-26 |
| 46 | 24-26 |
| 60 | 26-28 |

For purposes of this description, the base web of a preferred wrapper has a permeability of at least about 20 CORESTA units. Most preferably, the wrapper has a permeability greater than about 30 CORESTA, such as common base webs having nominal permeabilities of about 33 and about 46 CORESTA with a basis weight of about 25 gsm. For some applications, the base web may have a permeability of greater than about 60 CORESTA, or greater than about 80 CORESTA, or even higher permeability values.

Figure 3:
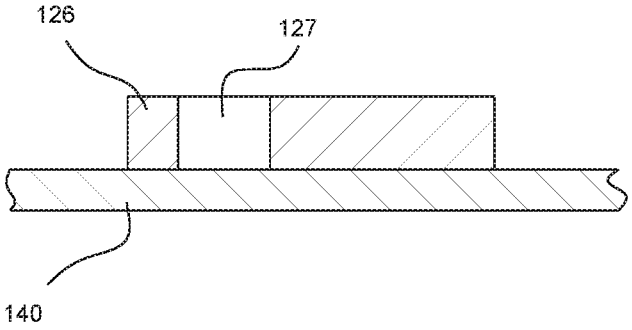
FIG. 3 is an enlarged cross-sectional view of the wrapper taken along the line 3-3 of FIG. 2.
Figure 4:
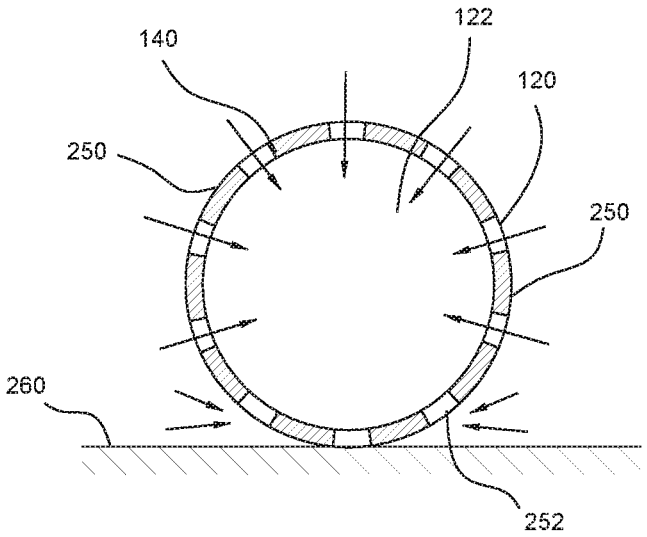
FIG. 4 is an enlarged cross-sectional view of the smoking article and an illustration of airflow into a smoldering smoking article when placed upon a substrate.
Figure 5:
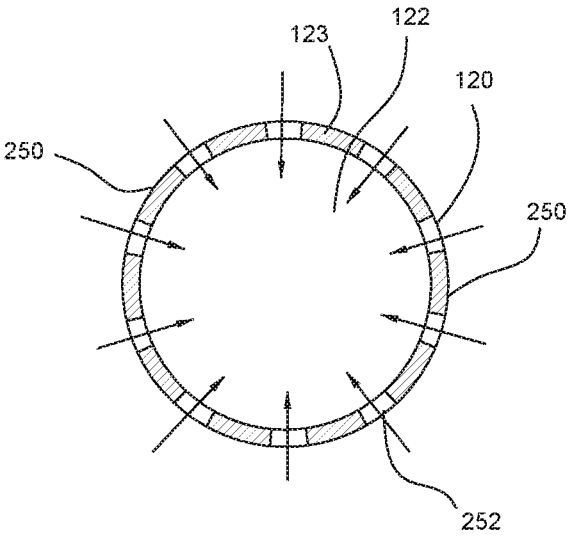
FIG. 5 is an enlarged cross-sectional view of the smoking article apart from any substrate and an illustration of airflow unto a smoldering smoking article in free-burn.

Depictions of cross sections taken through a banded or patterned paper, such as FIG. 3, are believed to be useful schematic representations of a paper web having banded regions fashioned from one or more layered applications, and of the application processes by which such banded or patterned papers are fabricated.

Such schematic descriptions of paper with one or more layers of add-on material are at significant variance with the real world results of applying one or more layers of add-on material to a base web 140. Accordingly, the schematic representations of add-on layers fairly show the process application rates, as might be used as a guide to etch application zones of a gravure print cylinder or the like. However, those schematic representations do not accurately represent the actual structure of the finished wrapper prepared by applying one or more layers of add-on material to a base web.

Each layer of add-on material may be substantially continuous, may have a uniform or variable thickness, and/or may have a smooth or rough surface.

Referring to FIGS. 1 and 2, the wrapper 123 preferably comprises a base web 140 and a plurality "banded regions" or "zones" 126 in which an add-on material has been applied to the base web 140 at spaced locations along the base web 140. Preferably, each band or zone 126 includes a leading edge 146 and a trailing edge 148 and a plurality of material-free openings 127 (i.e., "material-free regions") between the leading edge 146 and the trailing edge 148. The material-free regions 127 may be uniformly or randomly spaced within the band 126, and the band 126 may extend transversely and/or longitudinally along the wrapper.

Preferably, the banded regions 126 of add-on material are applied to the wrapper 123 in a single application (preferably a single-pass, gravure printing operation) with a nominal total band area (its width times the circumferential length) and including a pattern of material-free regions 127 that collectively establish a nominal opened-area of the banded region 126 in the range of about 4 to about 9% of the nominal total band area. The nominal total band area and the material-free regions 127 are configured so as to consistently (reproducibly) obtain requisite/satisfactory or improved Ignition Propensity ("IP") values together with improved Self-Extinguishment ("SE") characteristics when compared to a "solid" banded paper of similar construction, but lacking the material free regions 127 within the bands.

In addition, the inclusion of the material-free regions 127 in accordance with the teachings which follow provide a method of controllably achieving a desired, predetermined level of diffusivity in the banded region 126, such that IP and SE performance of a given banded paper can be consistently maintained from band to band and from paper to paper. The latter advantage is a consequence of an understanding that diffusivity of a banded region 126 correlates with IP performance and the discovery that intricate patterns may be printed within banded regions 126 by using the preferred application practices as taught herein such that the banded regions may be provided with tiny, but reproducible material-free zones that will provide predictable, reproducible, controllable levels of diffusivity.

The zones 126 of add-on material are spaced along the base web 140 such that at least one zone of add-on material 126 is positioned between the edge of the tipping paper 131 and the end of the lit end 124 of the tobacco rod 122 in each finished smoking article 120. The zone 126 of add-on material preferably extends in the circumferential direction at one or more spaced locations along the longitudinal axis 134, extending circumferentially about the tobacco rod 122 of the smoking article 120. Preferably, the zone 126 of add-on material is substantially continuous in its circumferential direction and width, but further includes a pattern of material-free regions 127. In the alternative, the material-free regions may be randomly positioned with a band.

Referring again to FIGS. 1 and 2, the "width" of a circumferential banded region 126 is measured in the longitudinal direction 142 from the leading edge 146 to the trailing edge 148 and preferably lies in the range of from about 4 to about 9 mm, more preferably from about 5 to about 7.5 mm, and even more preferably from about 5 to about 6 mm. Further, banded regions may have a "phase" (i.e., the spacing from the leading edge 146 of one banded regions 126 to the leading edge 146' of the next adjacent banded region 126) in the range of about 10 to about 35 mm, more preferably in the range of about 20 to about 30 mm, and even more preferably about 23 to about 27 mm. Preferably, the banded regions 126 of add-on material reduce permeability of the wrapper to the range of from about 0 to about 12 CORESTA, more preferably the range of from about 0 to about 10 CORESTA.

When using the preferred add-on solutions, base webs and application techniques of the teachings which follow, a printing solution, upon its application to a base web and drying, forms an air-occlusive film on the base web that is effective to locally reduce diffusivity values from a diffusivity level of about 2 cm/sec or greater (for the base web in its original condition) to a value in the range of 0.0 to about 0.25 cm/sec, more preferably less than about 0.15 to about 0.20 cm/sec, as measured by a Sodim $CO_2$ Diffusivity Tester (purchased from Sodim SAS of France).

To measure the diffusivity of a piece of paper using a Diffusivity Tester, the paper is positioned within a clamping head so that the paper separates two vertically arranged chambers. The upper chamber contains a carrier gas, such as nitrogen, while the lower chamber contains a marker gas, such as carbon dioxide. As there is no pressure difference between the two chambers, any migration of gases is due to differences in concentrations of the gases, and there is no permeability effect, which occurs when a pressure difference is maintained between two surfaces of the paper. After a predetermined period of time (e.g., for about 25 seconds or less), the concentration of carbon dioxide within the nitrogen stream of the upper chamber is measured in an analyzer. A computer then converts the detected level of concentration into a measure of diffusivity.

Because of the intricate size and nature of the material-free regions 127 of the preferred embodiments, the banded regions 126, together with their material-free regions 127, are preferably formed simultaneously by a single application of a film forming composition, preferably with a single-pass gravure printing operation, and preferably by applying a single layer of an aqueous, starch-based add-on solution using formulations and techniques as taught in US Patent Application Publication No. 2008/0295854 (now U.S. Pat. No. 8,925,556) and in US Patent Application No. 2012/0285477, (now U.S. Pat. No. 9,302,522), the entire contents of which are incorporated herein by reference. Surprisingly, a single-pass gravure application of those formulations in accordance with the further teachings which follow achieves a high-speed, accurate reproduction of each banded region together with its material-free regions 127, despite the intricate nature of the latter. Contrary to expectations, it has been found that the inclusion of material free regions (and the corresponding cell-free regions in the engraving of the gravure roll), promote a cleaner, more precise printing of add-on material onto the base web, without tendency of the add-on material to flow into the material-free regions 127 when using gravure printing techniques.

Other techniques may be used to produce the desired bands, such as xerographic printing, digital printing, coating or spraying using a template, or any other suitable technique or including a separate step for establishing material-free regions 127. However, single-pass, gravure printing techniques are preferred.

Referring now to FIG. 3, a cross-section of the banded region 126 along line 3-3 of FIG. 2 shows a substantially continuous band 126 of add-on material applied to the web 140. At least one material-free region 127 is provided within the band. In the preferred embodiment, a plurality of material-free regions 127 are provided wholly within the band 126 (i.e., spaced from the leading edge and trailing edge thereof) although embodiments could include placement of complete or partial material free regions along edge portions such as at the leading edge 146 and/or trailing edge 148.

Figure 10:
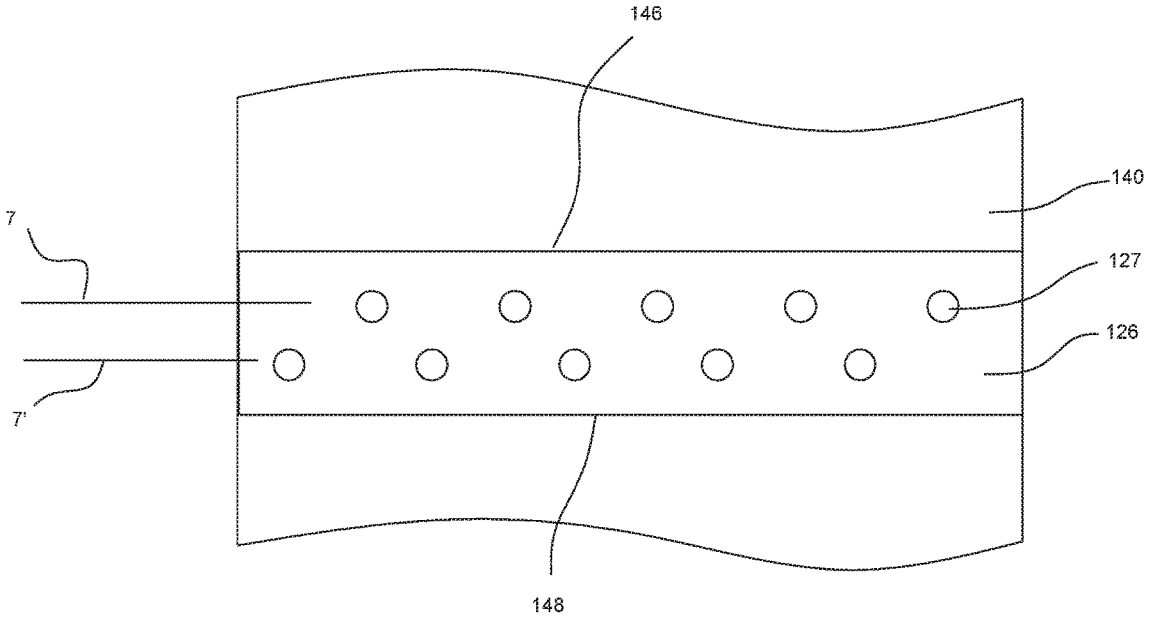
FIG. 10 is an enlarged planar view of a section of base web having a banded region with dot-like material-free regions.

Referring now to FIGS. 2 and 10, in a first preferred embodiment, the material-free regions 127 resemble circular dots and are arranged in one or more generally parallel, circumferentially extending and mutually offset rows 7 and 7' of dots 127. Along each row 7, each material-free region 127 is circumferentially spaced about 5.0 to about 6.0 mm from the next material-free region 127 within the same row 7. In the preferred embodiment, the dots 127 of one row 7 are circumferentially offset from those of the other row 7'. The center of a dot 127 of one row 7 maybe located about 1.5 mm to about 2.0 mm diagonally from the closest adjacent dot 127 of the other row 7'. Preferably, the diameter of each dot 127 is in the range of approximately 0.5 to 1.5 mm, more preferably in the range of approximately 0.7 to 1 mm. Although the preferred embodiment includes two rows of dots 127, fewer or a greater number of rows 7 is envisioned.

With the newly discovered capability to clearly print any desired intricate pattern of material free regions 127 within a band 126, one may alter the size (diameter), number or shapes of the dots 127 and/or change the number, spacing and mutual orientation of the rows 7 until desired a desired nominal opened-area is achieved such as one that has been shown to provide desired IP and SE performance characteristics or other attribute. For example regarding other attributes, it might be found advantageous to include several rows 7, with at least one row 7 being disposed along the leading edge portion 146 of the banded region 126, another row 7' being disposed along the trailing edge portion 148 and one or more intermediate rows 7" rows in between, with a size and/or number of the material-free regions 127 comprising the intermediate row or rows 7" differing from that of the other rows 7 and 7' rows near the edges.

As described in U.S. Patent Application Publication No. 2008/0295854 filed May 23, 2008, (now U.S. Pat. No. 8,925,556), the entire content of which is incorporated by reference thereto, preferably, a film-forming composition may be used to form the banded regions 126 The film-forming compound can include one or more occluding agents such as starch, alginate, cellulose, or gum and may also include calcium carbonate as a filler. Further, the film-forming composition preferably includes an anti-wrinkling agent. Where starch is the film-forming compound, a concentration of about 16% to about 26% may be particularly advantageous, and a concentration of about 21% is presently most preferred.

An "anti-wrinkling agent" is a material which abates the tendency of an aqueous solution to shrink a base web after its application and subsequent drying. A suitable anti-wrinkling agent may be selected from the group consisting of 1,2 propylene glycol, propylene glycol, and glycerin. Other anti-wrinkling agents can be used in addition to, or in lieu of the preferred materials. For example, other suitable anti-wrinkling agents include polyols, including without limitation, glycerol, polyethylene glycol, glucose, sucrose, isomalt, maltilol, sorbitol, xylitol, and other agents exhibiting comparable functionalities.

The film-forming composition may be applied to the base web of the wrapper 140 using gravure printing, digital printing, coating or spraying using a template, or any other suitable technique. If desired, the banded regions 126 of add-on material can be formed by printing multiple, successive layers, e.g., two or more successive layers registered or aligned with one another. However, because of the intricate dimensions of the material-free regions 127 of the various embodiments, a single-pass gravure printing operation is preferred.

For single-pass gravure printing operations, the aqueous starch solution of an embodiment comprises at least about 20% starch by weight; between about 6% and about 10% anti-wrinkling agent (preferably propylene glycol), and between about 10% and about 15% chalk (preferably a fine calcium carbonate) by weight of starch. Preferably the aqueous starch solution is applied at the press at a temperature between about 120 to 140 degrees F. and is preferably prepared and applied in accordance with those and other teachings of the commonly owned, U.S. patent application Ser. No. 13/324,747, filed Dec. 13, 2011, (now U.S. Pat. No. 9,302,522), the entirety of which is incorporated herein by reference. A preferred solution may comprise at the press (all percentages here being based on the total solution weight): starch—in an amount of about 18 to about 23 wt % (weight-percent), more preferably about 20 to about 22 wt %, and even more preferably about 21 wt % of the total solution weight; propylene glycol—in an amount ranging from about 7 to about 10 wt %, more preferably about 7 to about 9 wt %, and even more preferably about 8 wt % of the total solution weight; calcium carbonate—in an amount in the range of about 9 to about 13 wt %, more preferably about 10 to about 12 wt %, and even more preferably about 11 wt % of the total solution weight; with water essentially comprising the remainder (in an amount ranging from about 55 to about 65 wt %, more preferably about 60 wt %).

With inclusion of the chalk in this embodiment as described, one may abate the tendency of the banded paper cigarettes to self-extinguish, enhance appearance of the product to an adult consumer and achieve these and other associated advantages.

The inclusion of an anti-wrinkling agent (preferably, such a propylene glycol) in an aqueous starch solution used to make banded wrapper in a manner consistent with the teaching herein can reduce transverse shrinkage to operationally manageable levels, alleviate pronounced wrinkling and essentially eliminate creasing problems that previously presented themselves. Inclusion of an anti-wrinkling agent has been found to have additional benefits, too. Cracking and flaking at banded regions are believed to be alleviated. In addition, the presence of the anti-wrinkling agent is believed to cause the starch solution to reside more on the surface of the base web with less penetration into that material, and thus enhance film formation. Shrinkage of the wrapper in the vicinity of banded regions formed from an aqueous starch solution that includes an anti-wrinkling agent has been observed to be in the range of about 0.0625 to 0.125 in. for a 36 in. wide base web—a range which does not result in creasing nor excessive waviness in the base web. Furthermore, inclusion of an anti-wrinkling agent in the aqueous starch solution has been found to make possible the application of add-on material to be applied to the base web in a single application, printing pass, or the like, provided that sufficient drying capability is established with such practices. In addition, the shelf life of the aqueous starch solution is materially improved by the inclusion of an anti-wrinkling agent as disclosed herein.

Referring now to FIG. 2, the banded regions 126 of add-on material determine and regulate the IP and SE characteristics of the smoking article. Those zones 126 of add-on material are applied to a base web 140 (see FIG. 2) of the wrapper 123, which is then formed into a tobacco rod in conventional cigarette making equipment. Nominal permeability of the base web 140 may be in the range of about 25 to about 100 CORESTA. Currently, the preferred nominal permeability of the base web lies in the range of about 33 to about 65 CORESTA, with the most preferred nominal permeabilities being about 33 and about 60.

The banded regions 126 of add-on material may be applied to the base web 140 preferably by a printing technique. While one or more printing technique (selected from the group consisting of direct printing, offset printing, inkjet printing, gravure printing, and the like) may be used to apply the banded region 126, preferably a gravure printing process will be used. Gravure printing provides ample control over deposition rates, deposition patterns, and the like, and is suitable for high-speed printing on the base web 140. For purposes of this disclosure, "high-speed" printing refers to printing processes where the base web 140 advances through the printing process at a linear speed greater than about 300 feet/min. For cigarette manufacturing purposes, base web printing speeds greater than 450 feet/min. are preferred, and speeds greater than 500 feet/minute or more are even more preferred. In this regard, the rates of deposition for add-on material, as well as the quality of the pattern of deposited add-on material, can vary considerably when wrapper prepared by high-speed printing processes is compared with wrapper prepared by low-speed printing processes. Higher-speed printing operations can achieve production of wrappers capable of providing both desirable IP values (performance) and desired SE values (performance).

Remarkably, it has been found that a base web may be converted (printed) to include bands in accordance with the embodiment described with reference to FIGS. 2 and 3 at about 1000 feet per minute, with acceptable paper appearance (i.e., without quality defects) and without elevated or unacceptable statistical occurrences of creases or wrinkles.

This disclosure contemplates that various anti-wrinkling agents are suitable to attain the desired characteristics described herein. In particular, the anti-wrinkling agent is selected from the group consisting of glycerin, propylene glycol, and 1,2 propylene glycol. Glycerin is a preferred member of the anti-wrinkling agent group, however, 1,2 propylene glycol is the most preferred member of the anti-wrinkling agent group.

Banded regions or zones 126 of this disclosure preferably comprise an aqueous solution containing starch, chalk or $CaCO_3$, and an anti-wrinkling agent. While many types of starch are contemplated, tapioca starch is presently preferred for the starch component of the layers of add-on material. A suitable commercially available starch is FLO-MAX8 available from National Starch LLC (now Ingredion).

Many types of calcium carbonate particles are contemplated as falling within the spirit and scope of this disclosure. Presently, however, calcium carbonate available from Solvay Chemicals, Inc., as SOCAL 31 is a suitable commercially available calcium carbonate. SOCAL 31 is an ultrafine, precipitated form of calcium carbonate having an average particle size of about 70 nm (nanometers). Larger particles of calcium carbonate have been observed to not function as well in this application when compared to the ultrafine, precipitated form of calcium carbonate, due at least in part to the tendency of larger particles to precipitate from solution more quickly and due at least in part to the need for greater quantities to attain the beneficial characteristics discussed herein.

The film-forming compound can include one or more occluding agents such as starch, alginate, cellulose or gum and may also include calcium carbonate as a filler. Where starch is the film-forming compound, a concentration of about 21% may be advantageous. The film-forming composition may be applied to the base web of the wrapper 123 using gravure printing, digital printing, coating or spraying using a template, or any other suitable technique.

If desired, the material-free regions 127 may include geometric shapes other than circular shapes or dots including, for example, squares, diamonds, rectangles or other polygons, ovals or the like, all which are collectively referenced as "dot-like configurations" or "dot-like shapes" or the like.

The total, nominal basis weight of add-on material after drying for the banded region 126 (without consideration of the material-free regions 127) preferably lies in the range of about 0.5 to about 3 grams per square meter ("gsm"), more preferably at or about 1 to about 2 gsm. In one embodiment, a 5.5 mm wide band of an aqueous starch solution was applied at a rate of 1.7 gsm, after drying, with a 7% opened-area. Accordingly, the overall basis weight of the band is 1.7 gsm minus 7% of that (which equals approximately 1.6 gsm). Preferably, for purposes of this disclosure, it is preferred to apply the add-on material at a basis weight sufficient to assure occlusive effect, so that the level of diffusivity at the band may be controlled by the amount of opened-area established for the band by the material-free regions 127.

Non-banded areas of the base web preferably do not comprise and are essentially free of any permeability reducing add-on material.

The manufacture of base web 140 usually will include the production of a roll of base web of several feet across (usually about 3 to about 4 feet across or in transverse dimension). The base web is then drawn through a printing press or the like and rewound to produce a roll of banded paper, which is then slit into bobbins. Printing operations are preferably conducted on the rolls, but could be conducted after slitting. Preferably, the bobbins themselves will have a transverse dimension equivalent to the width needed to make tobacco rods 122 or an integral number of such widths (e.g., 1, 2, or 4 of such widths). The bobbins are adapted for use with typical cigarette making machinery. The wrapper preferably has a dimension in cross-direction that takes into account the nominal circumference of the tobacco rod and an overlapping seam. As a result, when the wrapper is slit, the smoking article formed therefrom always has a longitudinal seam with an exact overlap.

The base web advances or passes through a first gravure printing station where the first layer of each banded region is printed on the paper. The printing process may be applied to the "felt side" or the "wire side" of the base web, or both. Optionally, the wrapper passes through a second gravure printing station where a second layer of each banded region is printed on the corresponding first layer. Additional layers are applied in a similar manner as described. A single-pass operation is preferred when practicing the teachings herein.

When a aqueous starch solution is being used as the add-on material, its preparation for application before and at the printing press is preferably such that the add-on solution is maintained at or about 120° F. to about 140° F., as taught in commonly assigned U.S. patent application Ser. No. 13/324,747, filed Dec. 13, 2011 (now U.S. Pat. No. 9,302,522).

Figure 6:
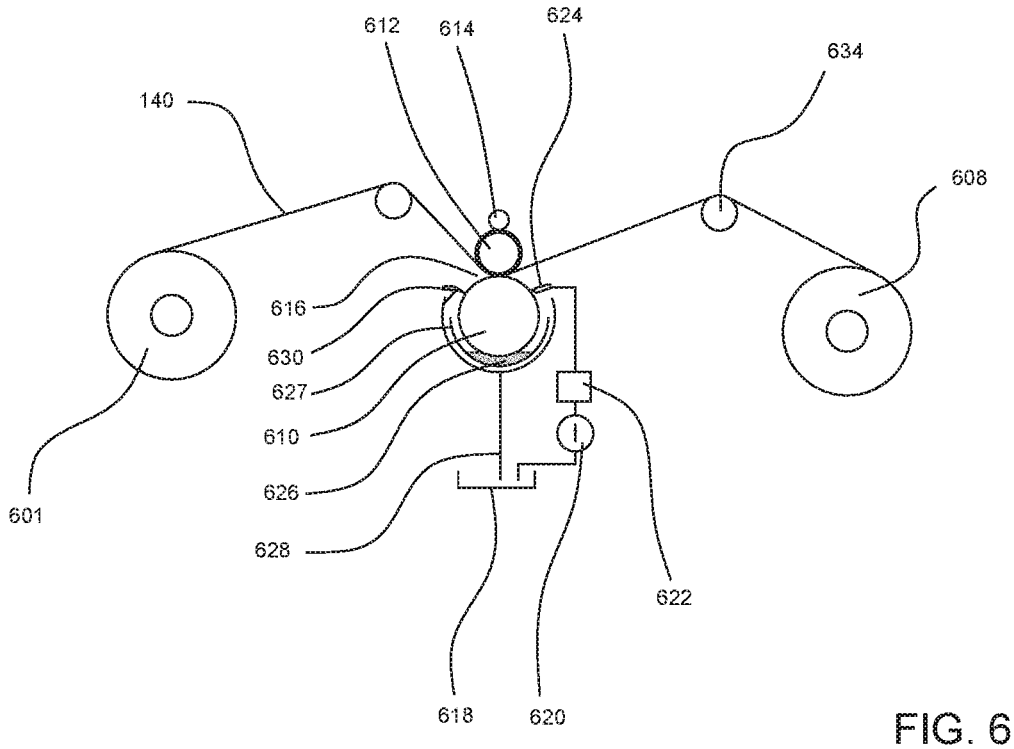
FIG. 6 is a schematic view of a gravure printing press suitable for producing embodiments of print banded wrapper as disclosed herein.

Referring now to FIG. 6, there is provided a schematic view of a preferred printing apparatus comprising a dispensing reel 601, a collection reel 608, an engraved printing cylinder (gravure roller) 610, an impression cylinder 612, an optional backing roller 614, a nip 616 defined between the cylinder 610 and 612, a reservoir of add-on material 618, a pump 620 operative to pump add-on material from the reservoir 618, a heat exchanger 622, an applicator 624, a bath 626, a collector 627, a drain 628, a doctor blade 630, and an idler roller 634.

The impression cylinder 612 is mounted for counter-rotation on an axis parallel to the axis of the printing cylinder (or gravure roller) 610. In some applications, the impression cylinder includes a nonmetallic resilient surface. The impression cylinder is positioned between the roller and an optional backing roller 614, which is also mounted for rotation on an axis parallel to the axis of gravure the roller 610 and which counter-rotates relative to the impression cylinder. One of the functions provided by the optional backing roller 614 is stiffening the central portions of the impression cylinder so that the uniform printing pressure is obtained between the gravure roller 610 and the impression cylinder 612. The gravure roller 610 and the impression cylinder 612 cooperate to define a nip 616 through which the base web is drawn during the printing process. The nip 616 is sized to pinch the base web as it moves between the gravure cylinder 610 and the impression cylinder 612. The nip pressure 612 on the base web ensures the correct transfer of the add-on material from the gravure roller 610 to the paper base web 140.

In a preferred embodiment, the reservoir 628 contains the occlusive composition (add-on material), preferably an aqueous starch solution as discussed above for forming banded regions on the wrapper. The reservoir communicates with a suitable pump 610 which is capable of handling the viscous occlusive composition. The occlusive composition may then flow to a suitable heat exchanger 622 where the temperature of the occlusive composition is elevated so that it lies in the range of about 40° to about 90° C. (about 120° F. to about 140° F.) so that the viscosity of the occlusive composition is adjusted to a level which is suitable for gravure printing and for maintaining desired conditions of the starch solution. As discussed above, gravure printing usually requires a viscosity of less than about 200 cP. Preferably, the temperature of the occlusive composition is selected so that the viscosity is less than about 100 cP. For example, the occlusive composition may have a viscosity of about 40-60 cP at about 120° F.

While a separate heat exchanger 622 is disclosed, it may be desirable to provide thermal conditioning of the occlusive composition in the reservoir 618 itself. For example, heating elements and stirring apparatus may be included in the reservoir 618 to maintain the elevated temperature for the occlusive composition. Placement of the thermal conditioning in the reservoir has the advantage of making pump selection and operating requirements simpler since the pump need not handle the occlusive composition at the higher viscosity associated with lower temperatures because the occlusive composition would already be heated and, therefore, at the lower viscosity. Whether thermal conditioning occurs in the reservoir or in a separate heat exchanger, it is important that the thermal conditioning step occur at a controlled temperature selected to avoid scorching the occlusive composition. Scorching can cause discoloration of the occlusive composition, and can affect the occlusive characteristics of the composition.

Additionally, it is important to maintain an aqueous starch solution at or about the range of about 120° F. to 140° F. prior to and during printing operations. Aqueous starch solutions tend to degrade irreversibly if allowed to drop below those temperatures.

Regardless of where the thermal conditioning step occurs, the heated occlusive composition is delivered to a suitable applicator 624 that spreads the occlusive composition across the width of the gravure cylinder. That spreading step may be effected by pouring or spraying the occlusive composition onto the gravure cylinder, or by delivering the liquid occlusive composition to a collector 627 to establish a bath 626 of occlusive composition in contact with a lower portion of the gravure cylinder 610. The gravure cylinder 610 may be heated to prevent premature cooling of the composition.

Generally, the collector 627 extends partially about the gravure roller to a height sufficient to collect the bath, but to a height well below the top of the gravure cylinder 610. When the bath reaches the top of the collector, occlusive composition can flow through a drain 628 at the bottom of the apparatus back into the reservoir. Thus, the occlusive composition circulates through the printing station and can be maintained at suitable printing viscosity by the thermal conditioning apparatus discussed above.

Figure 7:
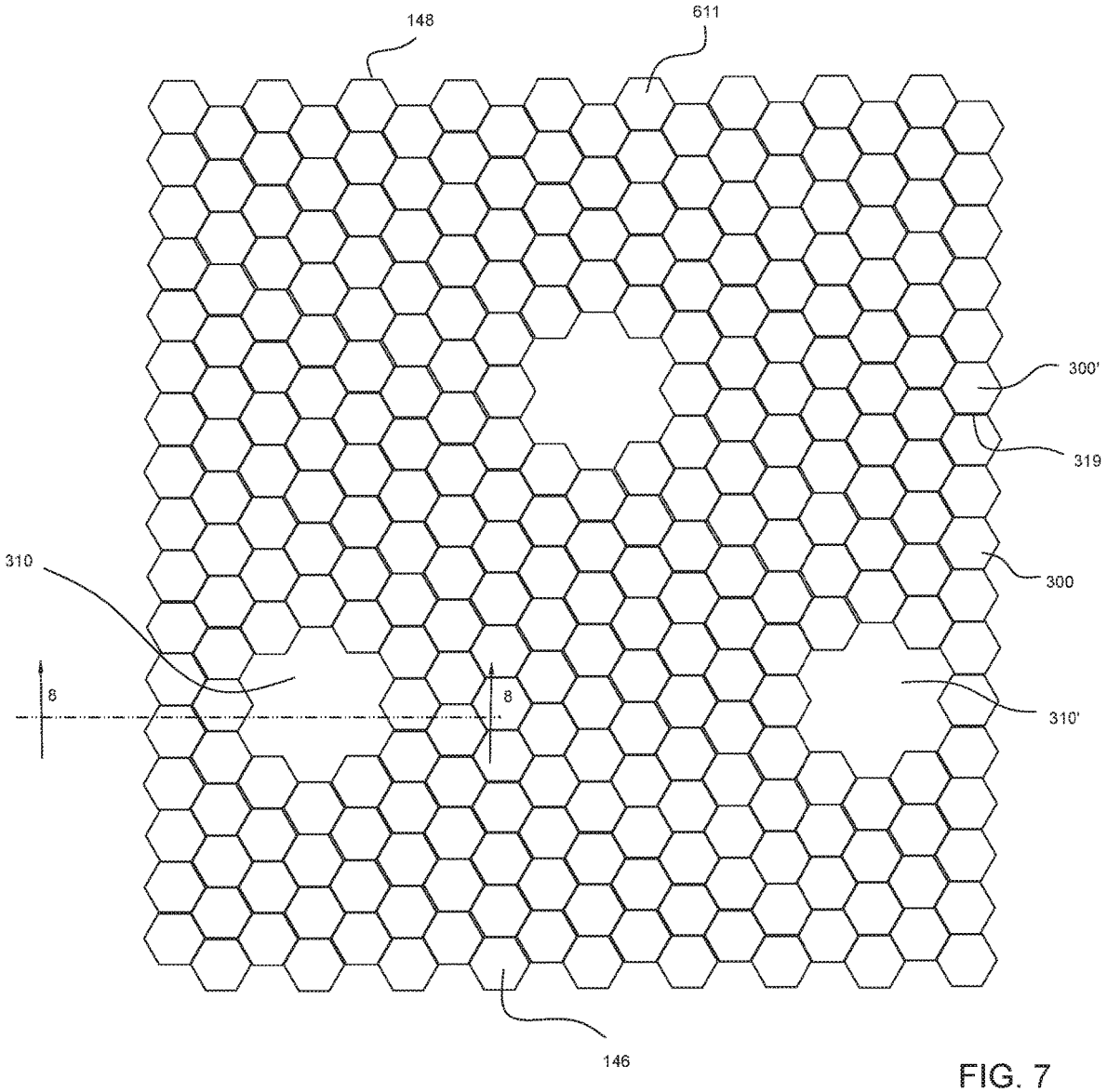
FIG. 7 is an enlarged schematic view of an engraved surface of a gravure roller as shown in FIG. 12, including cells and spaced-apart cell-free regions.
Figure 8:
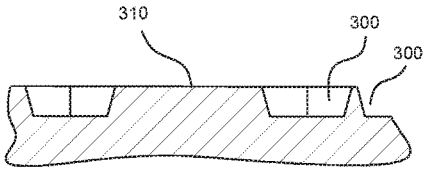
FIG. 8 is an enlarged cross-sectional edge view of the surface of the gravure roller along line 8-8 of FIG. 7.
Figure 11:
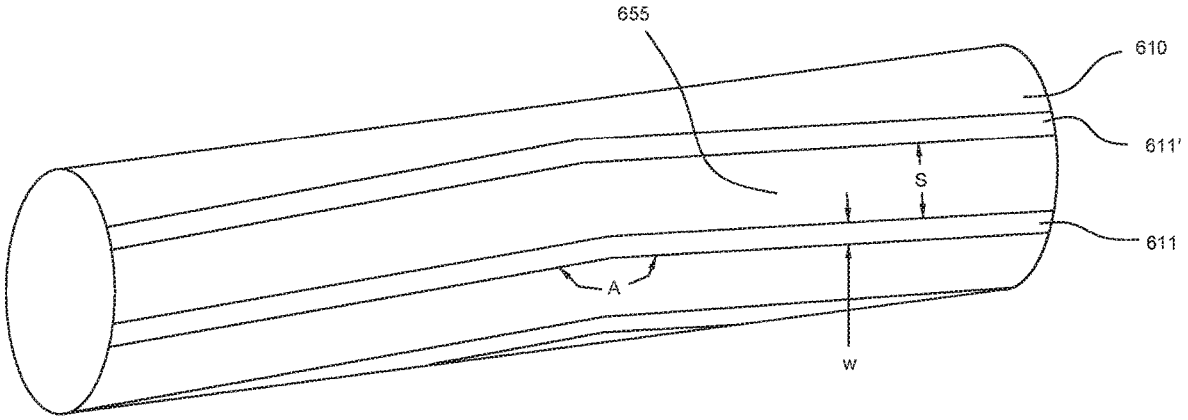
FIG. 11 is a perspective schematic of the engraved printing cylinder (gravure roller) of the gravure printing press shown in FIG. 6, it being configured to produce a bands on a base web such as shown in FIGS. 9 and 10.

Referring now to FIGS. 6, 7 and 11 the gravure cylinder 610 rotates through the applicator 624 and/or the bath 626, the occlusive composition adheres to the surface of the gravure cylinder 610, and fills the cells 300 (FIG. 7) provided at the etched regions 611 (FIG. 11) that establish the banded regions 126. Further rotation of the gravure cylinder (toward the nip) moves the cylinder surface past a suitable doctor blade 616. The doctor blade 616 preferably extends across and wipes the entire width of the gravure cylinder 610. In this way, the engraved regions 611 of the gravure cylinder 610 (FIG. 11) remain filled with the occlusive composition, but the un-etched regions of the gravure cylinder 610 (which define the nominal spacing between adjacent banded regions) is essentially wiped clean of the occlusive composition. The doctor blade 616 also wipes cell-free areas 310 within the engraved regions 611 clean of the occlusive composition, whereby the material-free regions 127 are established.

The occlusive composition is transferred to the surface of the base web 140 as the latter is drawn through the nip 616. Preferably, the base web 140 is drawn through the nip 616 at the same speed as the tangential surface speeds of the gravure cylinder 610 and the impression cylinder 612. In that way, slippage and/or smearing of the occlusive composition on the wrapper are avoided.

Referring now to FIG. 11, the preferred embodiment includes an engraved printing cylinder (print roller) 610 having a plurality of engraved regions 611, 611' in spaced-apart relation about the circumference of the cylinder 610 corresponding to the desired width "w" of the banded regions and the desired spacing "s" between bands as indicated by arrows "w" and "s" respectively, in FIG. 11. The details of the engraved regions 611, 611' in FIG. 11 and of the printed rows of banded regions 126, 126' in FIG. 9 have been omitted, but the omitted details would correspond, of course, with a desired pattern such as is appearing in FIG. 10 and/or other FIGs. Preferably the engraved regions 611 are each slightly angulated in the form of a chevron such that the angle "A" at the tip or apex of the chevron is preferably greater than about 170 degrees. Such arrangement helps relieve stress in the paper base web 123 upon application of the add-on material, which in turn, helps alleviate the tendency of the paper to pucker or wrinkle in the course of printing operations. It is envisioned that the engraved regions 611 might be instead arranged linearly without any chevon.

Preferably, the circumference of the roller is determined such that it is an integer multiple of the sum of the nominal distance between banded regions plus the banded region width. Thus, for each revolution of the roller, that predetermined integer number of banded regions is printed on the base web 123.

Referring now to FIG. 7, the generally cylindrical surface of the printing cylinder is etched (engraved) so as to establish within each engraved region 611 a plurality of cells 300, whose presence or absence, in effect, define a negative of both the application (or presence) of add-on material within the contemplated banded regions 126 and the absence of add-on material at the material-free regions 127 within each banded regions 126. As to the latter, the cell-free regions 310 (corresponding to the material free regions 127) are created during the etching process in accordance with the desire size, number and pattern for the material-free regions 127. The cell-free regions 310 in effect form "pillars" within the engraved regions 611 of the printing cylinder 610. Conventional engraving (etching), chemical engraving, electronic engraving, and photo etching can be used to pattern the surface of the gravure cylinder.

Preferably, when applying the preferred aqueous starch add-on material, each cell 300 is substantially hexagonal and has a bottom with a width of about 224 micrometers (μm) and a larger width at the top of about 290 micrometers (μm). The depth of each cell 300 is preferably about 57 micrometers (μm) and the tapering angle of cell walls from the top to the bottom is about 60 degrees. Adjacent cells 300, 300' are spaced about 12 micrometers (μm) from one another such that there is a wall 319 between them. In a preferred embodiment, the engraved region 611 extends approximately 18 cells across its width "w" (as shown in FIG. 11). In the preferred embodiment, each pillar, island, or cell-free area is preferably about the size of 7 contiguous cells.

Such arrangement produces a material free region in the range of approximately 0.7 mm to approximately 1 mm or more, when using the preferred aqueous starch add-on material. However, in other embodiments, each pillar 310 can be smaller or larger depending on the desired total area of regions 127 to be printed per band. Each pillar (in essence a group of contiguous, un-etched, hexagonal "cells") defines an area in the resulting band which will be substantially free of add-on material. In a preferred embodiment, the group of un-etched, contiguous hexagonal "cells" defines a generally circular, dot-like area 127 in the band. The minute hexagonal character of each un-etched hexagonal cells facilitates their use in establishing other desired shapes for the material-free regions 127, such as ovals and other rounded shapes, polygonal shapes including triangles, squares, rectangles, quadrilaterals, pentagons, heptagons, octagons and the like, and combinations thereof.

Among other advantages, it has been found that a pattern of pillars 310 within an engraved region 611 to create a pattern of off-set rows of material-free regions 127, such as shown in FIG. 1, promotes a better defined, more uniform and efficient application of composition to the base web 140 than when printing operations are conducted without the pillars 310. Not wishing to be bound by theory, it is believed that the pillars 310 provide localized, intermittent support to the doctor blade 630 as the engraved region and the pillars 310 passes underneath, which in turn reduces the tendency of the blade, when unsupported, to wipe material from the filled cells. It is believed that because of the presence of the cell-free regions ("pillars") 310, less, little or no composition is wiped away from the upper portions of the cells 300 by the doctor blade 630 so that consistently more composition remains within the cells 300 prior to printing. It is thus believed that the presence of pillars 310 promote a more uniform, more complete and consistent loading of the cells 300, which in turn promotes a more efficient and consistent transfer of add-on material to the base web.

Printing consistency and efficiency is further enhanced by elevating nip-pressure at the press. In a preferred embodiment, a nip pressure was increased by approximately 10 to 15% of the settings normally applied to the weight of paper and the add-on material, e.g., from a value of about 45-65 psi to a higher value of about 60-70 psi.

Figure 9:
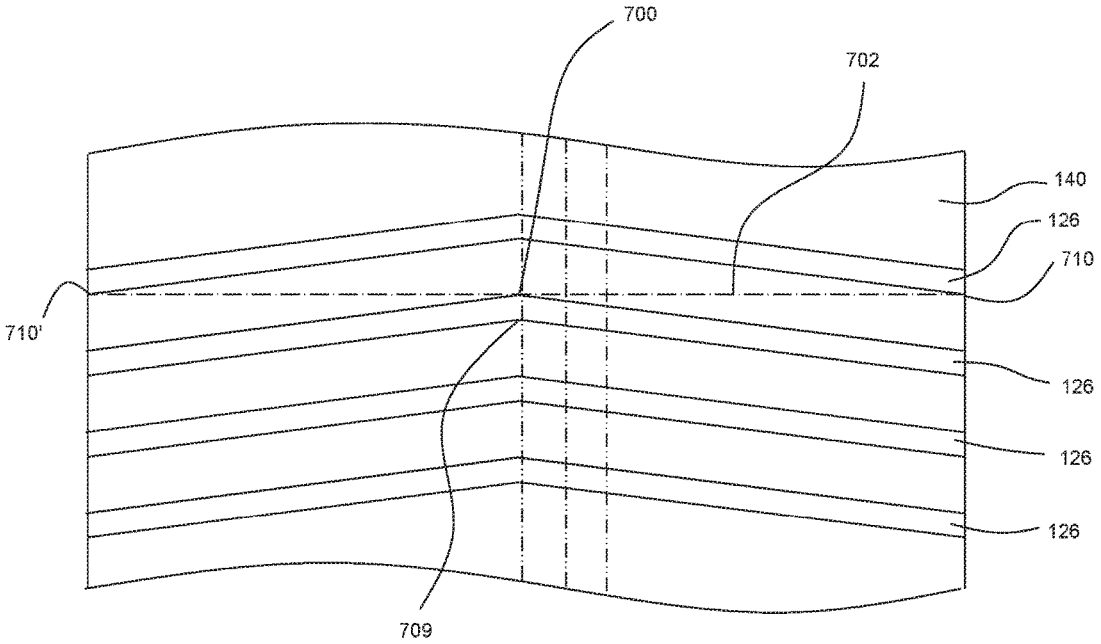
FIG. 9 is a schematic view of a base web having a plurality of bands printed thereon.

In the preferred embodiment, as shown in FIG. 9, each web 140 is printed with multiple bands 126 along the length thereof. Preferably, the banded regions 126 are printed in a chevron pattern on the base web (prior to slitting) such that the apex 700 in the leading edge 146 (FIG. 1) of each banded region 126 is essentially transversely disposed of the outer points 710, 710' (FIG. 9) on the trailing edge 148 (FIG. 1) of the preceding banded region 126 (FIG. 9). In other words, the apex 700 and the outer points 710, 710' essentially lie along an imaginary transverse line 702, which is substantially perpendicular to the marginal longitudinal edges of the web. It is envisioned that the angle at the apex 700 may be adjusted to re-establish the aforementioned relationship if the roll width is increased or decreased. Preferably, the apex angle lies in the range of about 0.5° to about 5°. In the alternative, the apex 700 may be established slightly ahead in a machine direction of outer points 710, 710' of an adjacent banded region 126.

The etched regions 611, 611' (FIG. 11) of the gravure roller 610 are configured and mutually arranged correspondingly. This chevron shape and relationship helps avoid excessive waviness in the web as a result of printing operations so that rewinding the printed web and the slitting the web into bobbins may be conducted without unacceptable occurrences of creases and tears. More particularly, it is to be noted that along any transverse region (or imaginary line) across the entire base web 140 after application of the add-on composition, the transverse region will include portions of the base web 140 that are not treated with add-on material as well as portions that are treated with add-on material. In contrast, without the chevons (i.e., the banded regions are arranged straight across the web), the shrinking effect of the aqueous add-on material during drying is localized at the location of the bands such that some transverse regions of the web is subject to all the shrinking effect and some adjacent transverse regions are not, which circumstance is known to exacerbate waviness, which in turn leads to creasing and tears in the web during rewinding and slitting. With the chevrons the shrinking effect of the add-on composition is distributed with a longitudinal component and no longer does any thin, imaginary transverse region bear the entirety of an application of add-on material. Consequently, tendencies for creasing and tearing is abated.

Accordingly, when the add-on material is dried, the related transverse web shrinkage is not localized in the printed (i.e., banded) areas, rather that shrinkage rate gradually increases from a minimum value at the band leading edge apex 700 to the band trailing edge apex 709, and remains substantially constant until the leading edge 146 of the band reaches the lateral edge of the band. From that location, the shrinkage decreases until the trailing edge of the band where the minimum shrinkage value exists. Thus, rather than step-wise shrinkage discontinuity, the chevron printing design gives gradual shrinkage variation and results in reduced waviness compared to prior techniques which used parallel bands disposed perpendicularly across the base web.

Once the base web 140 has been printed with the chevron shaped bands (see FIG. 9), the base web is slit longitudinally in to a plurality of parallel ribbons. Typically the base web may have a transverse width of about 50 inches, while individual ribbons may have a transverse width of about 26 to 28 mm. Accordingly, the base web 140 of about 50 inch width generates about 45 to about 50 ribbons. Each individual ribbon is collected by tightly winding it on a corresponding bobbin, where each bobbin may have a length of material on the order of 6,000 meters. The bobbins may then be used in conventional cigarette making machinery in combination with tobacco material to form a tobacco rod. The tobacco rods are then severed at predetermined lengths, such that filters can be attached with tipping paper to form finished cigarettes or smoking articles.

Preferably, each band 126 has a width ranging from about 4 mm to about 9 mm, preferably about 5 mm to about 7.5 mm, and even more preferably from about 5 to about 6 mm, and a transverse dimension determined by the nominal circumference of the tobacco rod and overlap along its seam. The number and size of the material-free regions 127 are selected such that constitute about 4% to about 9% of the total area of the band. In a preferred embodiment, the band 126 is about 5.0 to about 5.5 mm wide and the regions 127 constitute about 7% of the total area of the band 126. Such arrangement provides a more controllable level of diffusivity than is achieved with a solid band construction of similar dimensions, but lacking the material-free regions 127.

Generally and with the caveat of not wishing to be bound by theory, in the context of banded wrappers of smoking articles, diffusivity values of a given banded region are a function of two components: the first being the molecular diffusion of the test gas via Brownian motion through a given banded region (through the base web and its occlusive layer (film) of add-on material); and the second being the macro-level of diffusion of the test gas via mechanical flow through macro-level holes, channels, pores, interstices, or the like (where mechanical gas-dynamics apply). For a well-constructed solid band, the former predominates (which makes its diffusivity difficult to predict and to control). With a well-constructed solid band, there is little to no macro-component to the total diffusion. With bands constructed according to the teachings herein, that situation is purposely reversed.

We have come to realize that for a given band structure, its measured diffusivity levels are indicative of whether that band structure will achieve a desired IP performance. Thus, certainty as to a band structure's level of diffusivity can provide an acceptable level of certainty as to IP performance of that band structure. However, with solid bands (i.e., bands lacking material-free regions as taught herein), diffusivity is primarily if not entirely a function molecular diffusion (via Brownian motion) of gas through the base web and occlusive layer of the paper being tested. As a consequence, a solid band provides uncertainty as to its diffusivity and uncertainty as to its IP performance. Accordingly, solid bands tend to be over engineered to meet IP performance requirements, which in turn, tends to adversely impact SE performance.

To address the aforementioned shortcomings of solid bands, embodiments are provided which include, within each band, material-free regions 127 of sufficient aggregate proportional area of the band (e.g., the aforementioned 4 to 9% area ratio) such that the macro (mechanical) component of diffusion predominates over the molecular component, such that the diffusivity becomes controllable and IP performance predictable. As a result, band geometry of a given paper may be designed to provide predictable, reproducible, preferably non-zero, IP performance, which in turn, provides a margin with which to design banded papers having both a predetermined, non-zero level of IP performance and improved levels of SE. The technique is also believed to make the band performance more consistent despite variations in the coating solution over time or amongst production runs, reduce variation of diffusivity of the band over time (a more stable shelf life) and reduce differences in diffusivity values when measuring a band in a heated condition or in an unheated condition. The open area tends to absorb the mechanical stress developed in the covered area due to loss of moisture or other effects and reduce the possibility of crack development in the banded region.

Each such smoking article will include at least one and preferably two banded regions 126 (see FIG. 10). Within each banded region 126, a plurality of material-free regions 127 are established. In one embodiment, the material-free regions 127 are preferably arranged in a pair of generally parallel rows, such that the rows of material-free regions 127 are substantially parallel to both the leading edge and the trailing edge of the banded region. Preferably, the material-free regions of one row are transversely offset from the material-free regions 127 of the second row. Moreover, as noted above, the total area of all the material-free regions 127 comprises about 4% to about 9%, more preferably about 6% to about 8%, of the total area of the corresponding banded region 126. This preferred relationship between the material-free area and the banded area has been found to provide the desired IP and SE performance for the resulting smoking article.

By way of example, for a band having a nominal width of 5.5 mm and a circumferential length of 27 mm, ten (10) generally circular openings 127 each having a diameter of about 0.97 mm may be used. The generally circular openings 127 are preferably arranged in two generally parallel rows 7, 7' with five openings in each row. The two rows 7, 7' are arranged so that the centers for the material-free openings of each row are spaced about ⅓ of the width of the band from the adjacent edge of the band. Within each row, the material-free openings 127 are arranged such that the center of one opening is about 5.4 mm from the adjacent opening 127 in that row.

Moreover, the center of an opening in one row is spaced about 3.26 mm from the center of an opening in the second row. With this arrangement, the material-free openings of the band appear to allow air to enter the banded region when the smoking article is in a free-burn condition (i.e., held such that air has access to the entire circumference) so that the desired SE performance is obtained. However, when the smoking article rests on a substrate, that substrate occludes one or more of the material-free openings and the available airflow does not have free access to all of the other openings. Accordingly, there is insufficient air to support the smoldering coal and it extinguishes. As a result, the desired IP performance is obtained.

For example, a first IP and SE test was conducted with smoking articles constructed from twenty six bobbins of print banded paper comprising a 33 CORESTA base web with a two row array of material-free regions generally as described above, but of sufficient area to comprise 7% of the total area of the banded region 126. The add-on solution comprised water, starch, calcium carbonate and 1,2 propylene glycol. In a first test the overall IP Value was 5.8 and the overall SE average value was 69.0. In a second test of 26 bobbins, 33 CORESTA base web and 7% material-free area, the overall IP was 4.5 and the overall average SE value was 72.2. In comparison, some commercially introduced banded papers that achieve at or about 0% average IP values have average SE values of 100%. Accordingly, the test results indicate that a significant enhancement of SE performance may be achieved with the teachings herein, while maintaining requisite IP performance.

Figure 17:
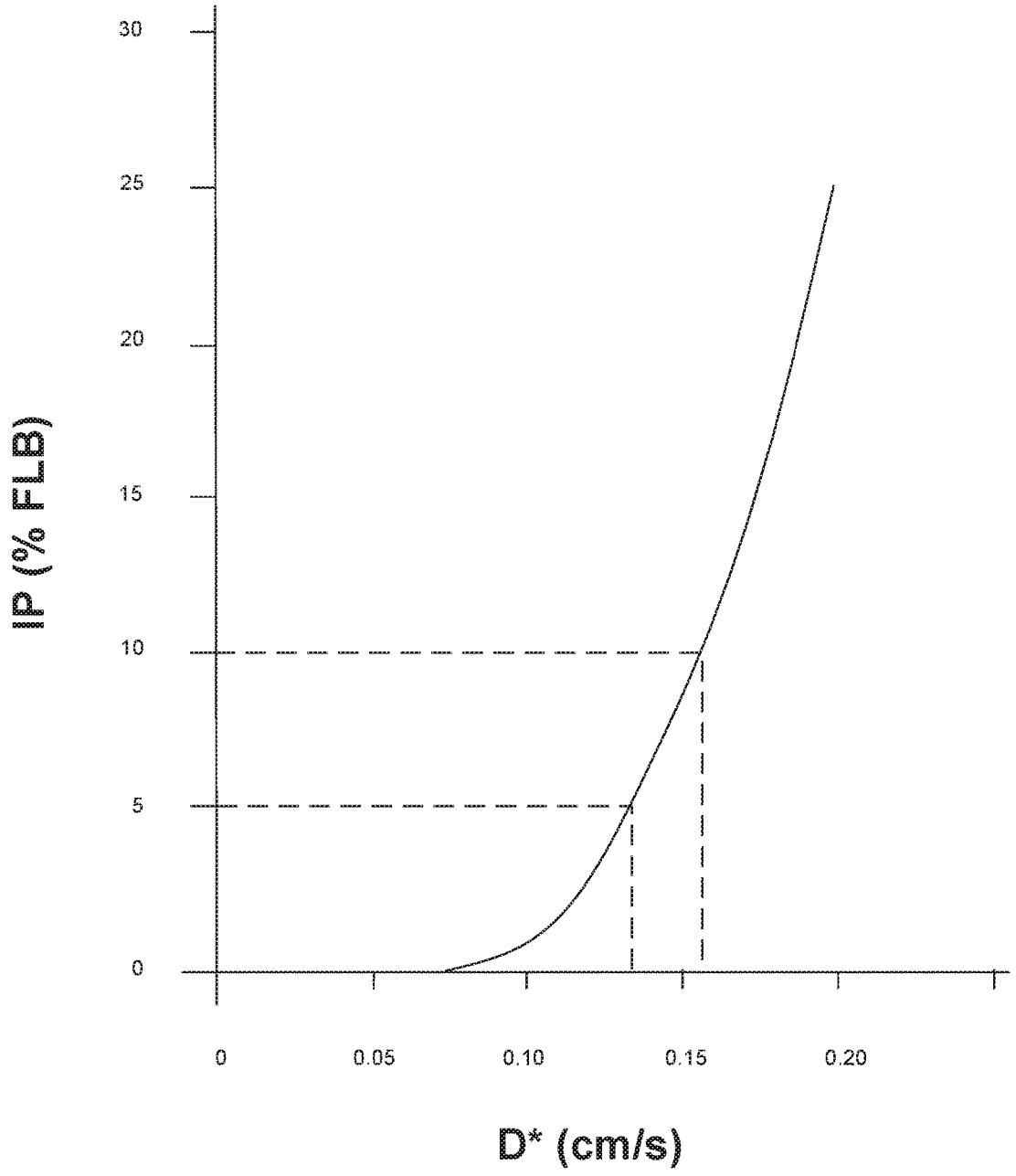
FIG. 17 is a graphical representation of a relationship between a measured diffusivity value D* and IP values obtained from testing certain solid banded papers constructed according to embodiments herein.
Figure 18:
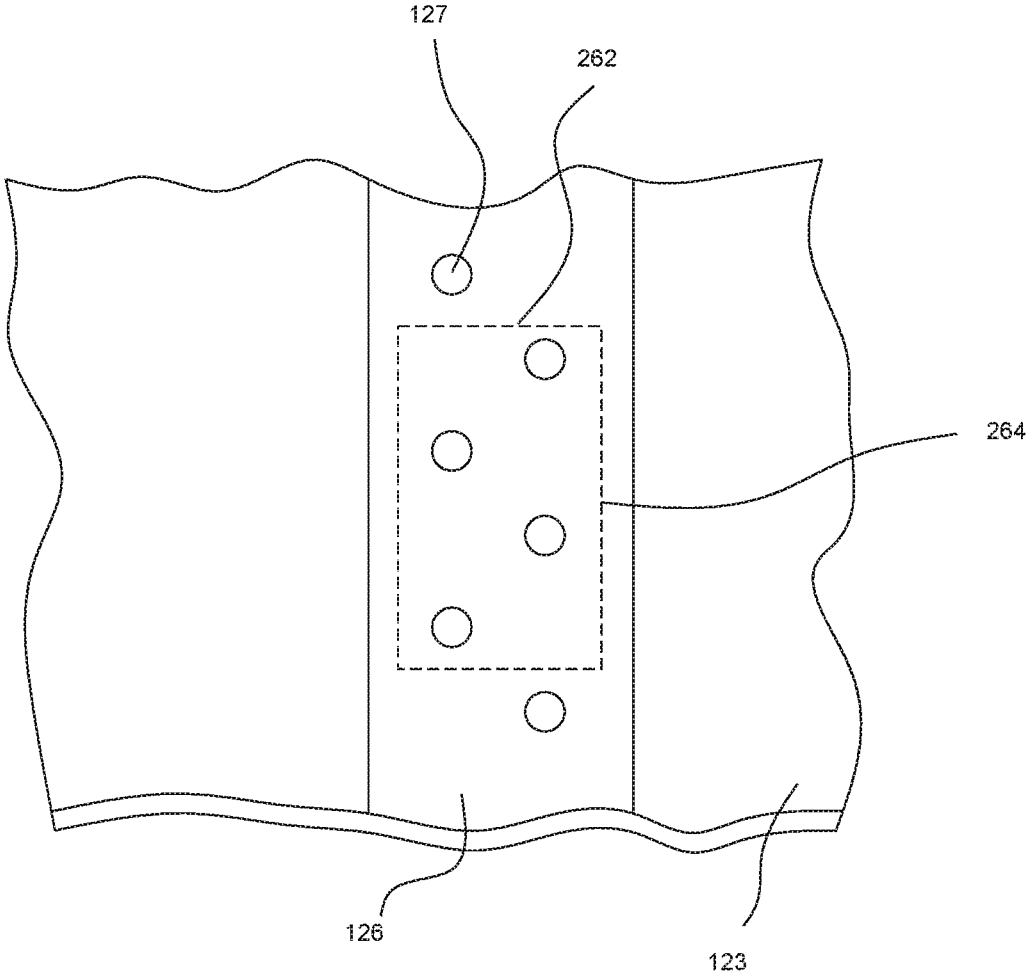
FIG. 18 is a planar view of a banded region constructed according to an embodiment with a representation of operative placement of a clamping head of a diffusivity test device.

Referring now to FIGS. 17 and 18, diffusivity is measured as previously described with a clamping head that is superposed over a banded region 126 and having a width (that is represented by a dotted line 262 in FIG. 18) of approximately 4 mm and a transversely oriented length of approximately 15 mm, such that its placement on the banded includes both regions of the band 126 to which occlusive add-on material has been applied and several of material-free regions 127 where add-on material have not been applied. Preferably, the head is positioned wholly within the banded region 126, because of the relatively large diffusivity value D* of untreated base web (2 cm/sec D* or greater verses 0.0 to 0.1 D* for the more usual "solid" banded regions).

Diffusivity testing was conducted amongst a variety of "solid" banded papers, which included 33 and 60 CORESTA base webs to which were applied aqueous starch solution which included calcium carbonate and propylene glycol for all of the 33 CORESTA papers and for some, but not all of the 60 CORESTA papers. Smoking articles were constructed and their IP performance tested.

From the resulting data these tests collectively established the relationship represented in FIG. 17 between IP performance and Diffusivity D*. Of those, it is understood that for those particular papers, diffusivity value D* of less than a "threshold D* value" of about 0.075 cm/sec will predictably provide a 0% IP value, together with a predicted, undesired 100% SE value. On the other hand, beyond a D* value of 0.16, IP performance begins to suffer penalty steeply with further increase in diffusivity, such that IP Performance soon becomes unacceptable. For those particular papers, the results also indicate that a D* value of about 0.13 or less may be desired to maintain an average IP performance value of about 5 and that that a D* value of approximately 0.15 may be desired to maintain an (average) IP performance value of about 10. SE values would be expected to improve with increasing diffusivity above the aforementioned threshold value (here, D* of approximately 0.075 cm/sec).

Advantageously, with opened areas (material free regions 127) being macro-sized and precisely printable, a desired diffusivity value D* may be targeted and then consistently reproduced from band to band and paper to paper so that a given banded paper has a desired level of IP performance together with improved SE performance. Here, the aforementioned solid bands may be modified to include material-free regions 127 and through modeling and testing of prototypes or the like, the size and number of material-free regions 127 would be resolved such that the nominal opened-area of the modified band achieves a desired diffusivity value, such as D* value in the range of about 0.12 to about 0.15 cm/sec.

Figure 12:
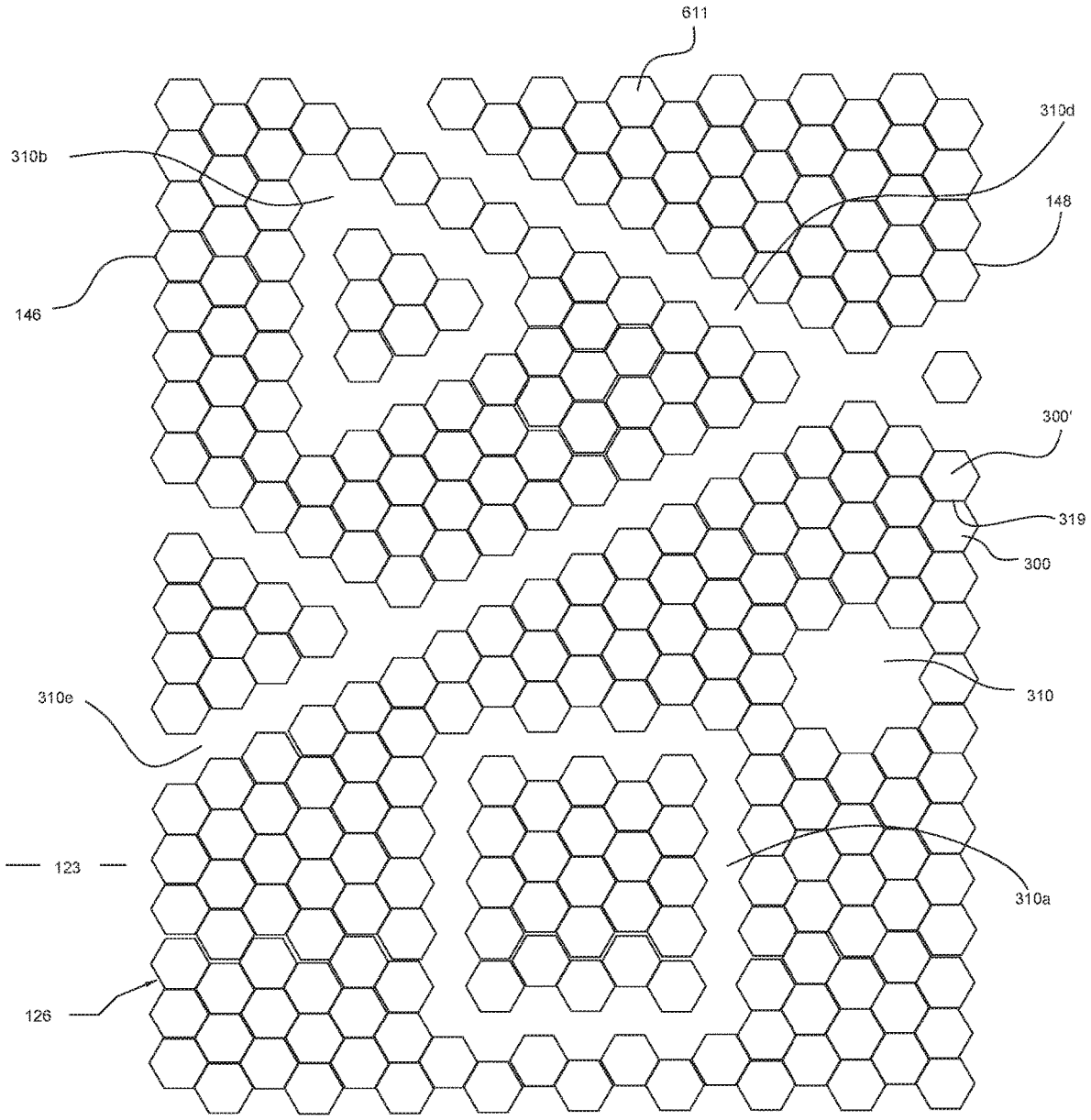
FIG. 12 is an enlarged schematic view of an engraved surface of a gravure roller as shown in FIG. 11, including cells and spaced apart cell-free regions and being configured to produce banded regions of alternative embodiments.
Figure 14:
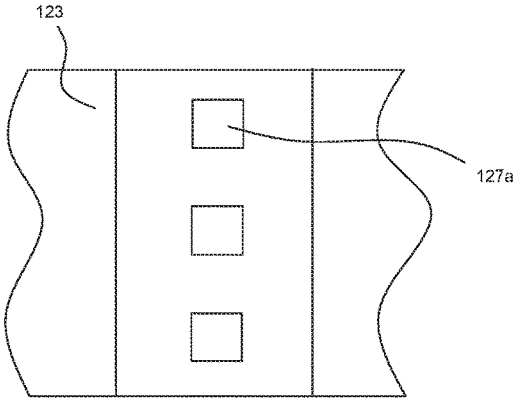
FIG. 14 is a top planar view of a banded paper constructed in accordance with another embodiment of the disclosure.
Figure 15:
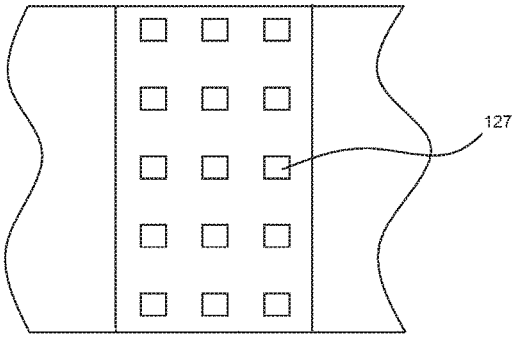
FIG. 15 is a top planar view of a banded paper constructed in accordance with yet another embodiment of the disclosure.
Figure 16:
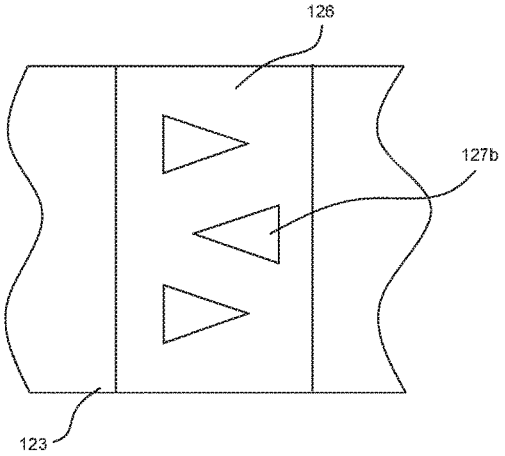
FIG. 16 is a top planar view of a banded paper constructed in accordance with still another embodiment of the disclosure.

Referring now to FIGS. 12 and 14, in another embodiment, the material free regions are configured as an outline or periphery of a geometric form, such as material-free region 127*a* in the form of the perimeter of a square. Of course, a correspondingly, square-shaped pillar 310*a* is established in the etched field 611 of the gravure cylinder 610. As to the later, in this embodiment, the desired square outline is established with lines of consecutive single cell-free zones (pillars), but could be configured instead with lines comprising dual or triple rows or more and/or include random or patterned breaks. Any of the many other possible geometric shapes could be employed instead, such as perimeters of triangles such as the triangular shapes 127*b*, 310*b* (of FIGS. 12 and 16) and small rectangles such as outlines 127 (of FIG. 15). Whatever the pattern, it is believed that they not only contribute a reproducible band construction of controlled diffusivity as previously discussed, but also an enhancement of desired film-forming effect as add-on material is applied to the base web 123 and then dried. It is believed that the presence of the material free zones helps localize film-forming event into discrete areas within the band, so that film forming can progress more completely. Such effect is addressed further in connection with the description of the embodiment which follows.

Figure 13:
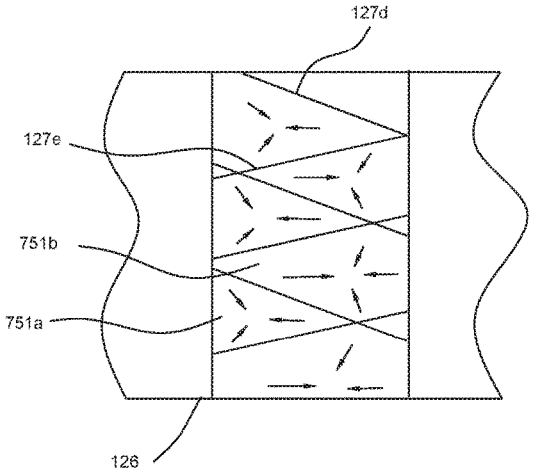
FIG. 13 is a top planar view of a banded paper constructed in accordance with another embodiment of the disclosure.

Referring now to FIGS. 12 and 13, in another embodiment, the geometric pattern may comprise a pattern of lines, such as, by way of non-limiting example, crisscrossed lines 127*d*, 310*d* and 127*e*, 310*e* of FIGS. 12 and 13, respectively. The lines and their lattice-like pattern are sized and configured to establish both a desired "opened-area" (such as 7%—so as to achieve a desired balance of IP and SE performance as previously taught), but also to divide the banded region 126 into discrete sub-zones 751*a*, 751*b*, such that the sub-zones may separately undergo physical, mechanical, chemical or other change separately of one another during the application and drying of add-on material (such each zone 751*a*, 751*b* contracting during drying as represented by minute arrows in FIG. 13). Such features and effect are believed to abate the formation of micro-fissures and/or macro-cracks in the applied and dried add-on material. In their absence, control of a given band's diffusivity level is enhanced, because it becomes more exclusively a function of the size and/or number of opened areas 127 within the band 126 via the material-free regions 127. Accordingly, abatement of fissures in the applied and dried add-on material enhances achievement of a banded paper having controlled diffusivity and/or other advantages.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

The terms and phases used herein are not to be interpreted with mathematical or geometric precision, rather geometric terminology is to be interpreted as meaning approximating or similar to the geometric terms and concepts. Terms such as "generally" and "substantially" are intended to encompass both precise meanings of the associated terms and concepts as well as to provide reasonable latitude which is consistent with form, function, and/or meaning.

It will now be apparent to those skilled in the art that this specification describes a new, useful, and nonobvious smoking article. It will also be apparent to those skilled in the art that numerous modifications, variations, substitutes, and equivalents exist for various aspects of the smoking article that have been described in the detailed description above. Accordingly, it is expressly intended that all such modifications, variations, substitutions, and equivalents that fall within the spirit and scope of the invention, as defined by the appended claims, be embraced thereby.

We claim:

1. A wrapper of a smoking article, comprising:

a base web; and a plurality of banded regions of add-on material applied to said base web, at least some of said banded regions comprising a leading edge and a trailing edge and a plurality of add-on material-free openings between said leading edge and said trailing edge, said openings establishing a predetermined, nominal opened-area within said banded regions in the range of about 4% to about 9% of a total nominal area of said banded regions, wherein the add-on material is a dried film of an aqueous solution which includes an anti-wrinkling agent, calcium carbonate and starch.

2. The wrapper of claim 1, wherein said plurality of add-on material-free openings comprises a pattern of rows of dot shaped openings.

3. The wrapper of claim 2, wherein at least two of said rows are mutually offset from one another.

4. The wrapper of claim 2, wherein said plurality of add-on material-free openings comprise a first plurality of add-on material-free openings disposed adjacent an edge portion of a respective one of said banded regions and a second plurality of add-on material-free openings disposed more intermediately of said leading and trailing edge portions of said respective one of said banded regions, said first and second pluralities differing in size, number or both.

5. The wrapper of claim 2, wherein the add-on material is a single layer.

6. The wrapper of claim 1, wherein said plurality of add-on material-free openings comprises a pattern of linear material-free openings.

7. The wrapper of claim 6, wherein said pattern has a lattice shape.

8. The wrapper of claim 1, wherein said plurality of add-on material-free openings comprises about 6 to about 8% of the total nominal area of the banded regions.

9. The wrapper of claim 1, wherein the add-on material is applied as a single layer.

10. The wrapper of claim 1, wherein each of the banded regions is about 5.0 mm to about 9 mm in width and about 26.0 mm to about 28.0 mm in transverse length.

11. A wrapper of a smoking article, comprising:

a base web; and a plurality of banded regions of add-on material applied to said base web, at least some of said banded regions comprising a leading edge and a trailing edge and a plurality of add-on material-free openings between said leading edge and said trailing edge, said openings establishing a predetermined, nominal opened-area within said banded regions in the range of about 4% to about 9% of a total nominal area of said banded regions, wherein the add-on material is applied as a single layer, the add-on material has been applied as an aqueous solution which includes an anti-wrinkling agent, calcium carbonate and starch.

12. The wrapper of claim 11, wherein the anti-wrinkling agent is selected from the group consisting of propylene glycol; 1,2 propylene glycol; and glycerin.

13. The wrapper of claim 12, wherein said add-on material-free openings are arranged in a first row and a second row.

14. The wrapper of claim 13, wherein add-on material-free openings of said first and second rows are mutually offset from one another.

15. The wrapper of claim 14, wherein a center of each of the add-on material-free openings is about 5.0 mm to about 6.0 mm from the center of an adjacent one of the add-on material-free openings of the same row; and a center of each of the add-on material-free openings of said first row is located about 1.5 mm to about 2.0 mm diagonally from an adjacent one of the add-on material-free openings of said second row.

16. A wrapper of a smoking article, comprising:

a base web; and a plurality of banded regions of add-on material applied to said base web, at least some of said banded regions comprising a leading edge and a trailing edge and a plurality of add-on material-free openings between said leading edge and said trailing edge, said openings establishing a predetermined, nominal opened-area within said banded regions in the range of about 4% to about 9% of a total nominal area of said banded regions, wherein the add-on material is a single printed layer of an aqueous solution comprising a starch, a calcium carbonate and a propylene glycol.

17. The wrapper of claim 16, wherein the base web has a permeability of greater than about 20 CORESTA.

18. The wrapper of claim 17, wherein the base web has a permeability of less than about 100 CORESTA.

19. A wrapper of a smoking article, comprising:

a base web; and a plurality of banded regions of add-on material applied to said base web, at least some of said banded regions comprising a leading edge and a trailing edge and a plurality of add-on material-free openings between said leading edge and said trailing edge, said openings establishing a predetermined, nominal opened-area within said banded regions in the range of about 4% to about 9% of a total nominal area of said banded regions, wherein each of said banded regions exhibits a diffusivity value in the range of about 0.12 to about 0.15 cm/sec.

* * * * *